US006463988B1

(12) United States Patent
Mullet et al.

(10) Patent No.: US 6,463,988 B1
(45) Date of Patent: Oct. 15, 2002

(54) WIND-RESISTANT SECTIONAL OVERHEAD DOOR

(75) Inventors: Willis J. Mullet, Pensacola Beach; Allen C. McDowell, Gulf Breeze; David C. Allis, Cantonment, all of FL (US)

(73) Assignee: Wayne-Dalton Corp., Mt. Hope, OH (US)

( * ) Notice: Subject to any disclaimer, the term of this patent is extended or adjusted under 35 U.S.C. 154(b) by 0 days.

(21) Appl. No.: 09/616,565

(22) Filed: Jul. 14, 2000

Related U.S. Application Data

(62) Division of application No. 09/081,419, filed on May 19, 1988, now Pat. No. 6,112,799.

(51) Int. Cl.[7] ..... E05D 15/16

(52) U.S. Cl. ..... 160/201; 160/209

(58) Field of Search ..... 160/201, 209, 160/133, 264, 236, 202; 49/367, 369; 292/DIG. 36, 109, 341.12, DIG. 40, 74, 75, 65, 63; 52/202

(56) References Cited

U.S. PATENT DOCUMENTS

| | | | | |
|---|---|---|---|---|
| 853,272 A | * | 5/1907 | Stodden | |
| 1,530,762 A | | 3/1925 | Dautrick | |
| 1,865,747 A | * | 7/1932 | Dorey | |
| 1,891,496 A | * | 12/1932 | Bedford | |
| 1,990,870 A | | 2/1935 | Kelly | 20/20 |
| 2,090,146 A | | 8/1937 | Pixley | 160/209 |
| 2,124,969 A | | 7/1938 | Bagley et al. | 160/209 |
| 2,156,874 A | * | 5/1939 | Schonitzer | |
| 2,678,689 A | | 5/1954 | McKee | 160/201 |
| 2,908,051 A | * | 10/1959 | Sparkes | 160/202 |
| 3,104,699 A | | 9/1963 | Wolf et al. | 160/201 |
| 3,265,118 A | | 8/1966 | Smith | 160/209 |
| 3,424,223 A | | 1/1969 | Rosenblatt | 160/201 |
| 3,443,625 A | * | 5/1969 | Moser et al. | |
| 3,516,474 A | | 6/1970 | Pemberton et al. | 160/209 |
| 3,552,474 A | | 1/1971 | Finnegan | 160/201 |
| 3,635,277 A | | 1/1972 | Bahnsen | 160/191 |
| 3,693,693 A | | 9/1972 | Court | 160/201 |
| 4,055,024 A | | 10/1977 | Frank | 49/153 |
| 4,065,900 A | | 1/1978 | Eggert | 52/476 |
| 4,069,641 A | | 1/1978 | Dezutter | 52/202 |
| 4,083,156 A | | 4/1978 | Tye | 52/127 |
| 4,194,549 A | | 3/1980 | Lövgren | 160/84 |

(List continued on next page.)

FOREIGN PATENT DOCUMENTS

| | | | |
|---|---|---|---|
| DE | 35 25 295 A1 | 1/1987 | E05D/15/24 |
| WO | PCT/US96/01794 | 8/1996 | E06B/9/17 |

*Primary Examiner*—Blair M. Johnson
(74) *Attorney, Agent, or Firm*—Renner, Kenner, Greive, Bobak, Taylor & Weber

(57) ABSTRACT

A wind-resistant sectional overhead door (21) selectively moveable between an open position and a closed position relative to a door opening defined by spaced vertical jambs (23,24) and a horizontal header (25) extending therebetween including, a plurality of elongate horizontal panels (40–43) pivotally connected at the top and bottom edges (48, 49) of adjacent of the panels, roller tracks (31, 32) mounted on the vertical jambs to either side of the door, roller shafts (65) mounted at the ends of the panels, guide rollers (66) carried by the roller shafts and engaging the roller tracks, and restraining members (70, 170) for limiting axial movement of the roller shafts, whereby the roller shafts and the panels are tension-loaded when the door is in the closed position to prevent buckling of the panels under applied wind forces. The restraining members may be replaced by or supplemented with tension rod assemblies (225, 325). The performance of the door may be enhanced by utilizing header lock mechanisms (95, 395), beam assemblies 285, and bottom cleat assemblies 290.

10 Claims, 16 Drawing Sheets

U.S. PATENT DOCUMENTS

| | | | | | |
|---|---|---|---|---|---|
| 4,467,853 | A | | 8/1984 | Downey, Jr. | 160/133 |
| 4,478,268 | A | | 10/1984 | Palmer | 160/310 |
| 4,601,320 | A | | 7/1986 | Taylor | 160/271 |
| 4,611,848 | A | | 9/1986 | Romano | 296/98 |
| 4,872,634 | A | | 10/1989 | Gillaspy et al. | 248/354.3 |
| 4,900,040 | A | | 2/1990 | Miller | 160/201 |
| 4,934,439 | A | | 6/1990 | Martin | 160/201 |
| 5,129,693 | A | * | 7/1992 | Schmitt | |
| 5,346,754 | A | | 9/1994 | Yun | |
| 5,383,509 | A | | 1/1995 | Gaffney et al. | 160/209 |
| 5,445,207 | A | | 8/1995 | Romanelli et al. | 160/209 |
| 5,522,446 | A | | 6/1996 | Mullet et al. | 160/201 |
| 5,584,332 | A | | 12/1996 | Miller | 160/201 |
| 5,620,038 | A | | 4/1997 | Decola et al. | 160/209 |
| 5,655,462 | A | * | 8/1997 | Holler | |
| 5,657,805 | A | | 8/1997 | Magro | 160/133 |
| 5,749,407 | A | | 5/1998 | Brenner et al. | 160/201 |
| 5,819,834 | A | * | 10/1998 | Wedekind | |
| 5,857,510 | A | | 1/1999 | Krupke et al. | 160/220 |
| 5,964,269 | A | * | 10/1999 | Decola | |
| 6,082,431 | A | * | 7/2000 | Decola | |
| 6,112,799 | A | * | 9/2000 | Mullet et al. | |

* cited by examiner

WIND-RESISTANT SECTIONAL OVERHEAD DOOR

This is a divisional of our application Ser. No. 09/081,419 filed May 19, 1998, entitled "Wind-Resistant Sectional Overhead Door", now U.S. Pat. No. 6,112,799.

TECHNICAL FIELD

The present invention relates generally to sectional overhead doors commonly used to selectively close openings in residential and commercial buildings. More particularly, the present invention relates to sectional overhead doors that are designed to withstand substantially greater wind-loading conditions than conventional doors. More specifically, the present invention relates to design features that may be incorporated in or added to sectional overhead doors to resist damage from extreme wind-load conditions or to at least minimize damage to such an extent that a door so configured remains operative after excessive wind-loading conditions.

BACKGROUND ART

Due to the relatively high incidence of severe weather conditions where high winds have caused a considerable amount of damage to residential and commercial structures, there has recently been a greater awareness that door systems, if strengthened, could prevent damage to the structures. This can have the effect of greater safety for occupants of the structure in terms of a reduced likelihood of injury to the occupants, as well as providing an avenue for escape from the structure, if necessary. Building code officials have been influenced by this public awareness, as well as by insurance company interests, to increase building code requirements for resistance to high wind-velocity pressures to reduce damage, loss of property, and loss of lives. Thus, the wind-load requirements for overhead sectional doors in higher risk areas are in the process of being, or have been, increased.

Over the years attention has been given, due in part to code requirements, to increasing resistance of doors to wind-velocity pressures. Most commonly, these efforts have resulted in proposals for increasing the thickness of the door and/or adding trusses and beams to the back or inner side of the door as strengthening members. Due to conservation of material considerations, supplementing strength has normally taken the form of beams and struts that are attached to and extend horizontally of the door structure on the inner face of the door. Such beams and struts are designed to create a stiffer or more rigid door section by positioning them such that the stresses generated by wind-velocity pressures against the door section are transmitted to the beams and struts and subsequently to the jambs, header, or even the floor of the building as stress forces operating primarily parallel to the direction of the wind. These beams and struts are variously made of materials such as solid wood beams and U-shaped or C-shaped channels of steel. As these components are normally sizeable, they have significant weight, and to provide adequate reinforcement, it is common to employ six to eight beams or struts on a door.

The use of such beam or strut-reinforcing members is disadvantageous in numerous respects. The weight of the beams, along with the components necessary to effect attachment to the door, often doubles or triples the weight of the door. The cost of the beam and strut materials is normally quite high due to the size and weight of the components involved. The substantial additional weight also makes a door more difficult to install and necessitates two installers.

Further, struts and beams are commonly two to six inches in height and, thus, protrude a substantial distance from the inner surface of the door, such that they are aesthetically unsightly and take up space inside the building. As a result, additional clearance is required when closing the door behind a vehicle, and when the door is in the open position, the beams protrude downwardly into the headroom area to an extent that may prevent the parking of taller vehicles, such as sport utility models, in garages having relatively limited overhead height.

A main operational disadvantage of using conventional beams and struts is that an adequate number of the substantial size normally employed causes the door to become rigid by adding beam strength to the door panels. As a result, the bending moment operative on the panels when wind loaded puts one side of a door section into greater tension and the other side of the door section into greater compression due to the greater size and thus greater moment arm created by the beams. This achieved rigidity, therefore, does not allow the door to flex without severely compression loading one side of the door section, which leads to the failure of the door sections by way of buckling. When buckling commences, the first thing that fails is the channels or struts, which rupture dramatically, thus causing the door sections to become permanently deformed, normally to such an extent that the door will not operate. This is because the substantial sized channels, struts, or bars used to prevent failure are of sufficient strength such as to preclude recovery adequate to allow the door to be operable once buckling occurs.

Another type of design that is employed to resist wind load in doors is referred to in the art as windlocks. Windlocks are locking devices located on the end portions of door sections that lock the door to the track system or to the jamb when the door is closed. Windlocks allow stresses generated by wind-velocity pressure that is exerted on door sections to be transferred to the doorjamb or other building structure. Windlocks have been employed primarily in relation to rolling doors since the slats of a rolling door cannot feasibly be reinforced with beams or struts because they would interfere with or render excessively large the rolled up condition of the rolling door when it is in the open or stored position. Further, with the narrow slat configuration necessarily employed in rolling doors, sizeable beams or struts are impractical and would create the possibility of binding or jamming of the door in the stored position. Efforts to employ windlocks on sectional doors require accurate alignment of the interengaging elements; otherwise, interference can readily occur. In addition, only a very limited number of windlocks can be employed on the jamb of a conventional sized door without the necessity for employing oversized reinforcing elements or intricately-configured interconnection elements.

Another design area for reinforcing sectional overhead doors that has gained interest in recent years relates to the utilization of vertical reinforcing posts. In such designs, a plurality of vertical posts are provided that divide the horizontal span of the door into reinforced areas with increased rigidity, and the wind-velocity pressure loads are transferred to the floor and the header above the door. Some of these designs employ vertical posts that can be retrofitted to an existing door but render the door inoperable after installation. These vertical post designs, if permanently attached to the door, add additional weight to be counterbalanced and also protrude into the interior space in the closed and opened positions in the same manner as horizontal struts or bars. Since vertical reinforcing posts require attachment to the header of the garage door opening, problems may be presented, particularly in retrofitting, because in many instances, garage door headers are not structurally designed to accommodate stresses of the magnitude that may be imparted. Similarly, the bottom of the post must be attached to the floor, and in many cases, the foundation is not designed to handle the stresses that may develop, which can result in cracking of the foundation slab. In the instance of dirt floors in a building, it is necessary to pour pilings in the floor to provide an adequate anchoring point for such vertical post anchoring. In some instances, the floor-anchoring structure protrudes above the surface of the floor and, thus, becomes a surface obstruction in the floor. In instances where holes are provided in the floor to effect engagement with the vertical posts, the holes may collect dirt or debris, thus rendering them inoperative for their intended purpose.

In longer door applications, header locks have been employed primarily to preclude separation of the door from the header during wind loading. Conventionally, these header locks take the form of opposed flat plates that move into overlapping, parallel but spaced relation when the door moves into the closed position. As a door deflects under wind loading, the header lock engages and limits further deflection of the top door panel in the area where the header lock is mounted. Such header locks also prevent the top door panel from rotating, which is an inherent tendency due to the substantially greater deflection of a door proximate its horizontal and vertical medial area. As a result, torsional stress concentrations may be created in the areas where such a header lock attaches to the door, whereby otherwise premature buckling of the panel may occur.

Therefore, existing approaches to the reinforcement of sectional overhead doors to withstand high wind-velocity pressures, both positive and negative, have embraced the concept of reinforcement of the door sections to render their construction as stiff or rigid as possible. This is coupled with the usage of beams, bars, or posts of substantial dimension, which, in varying fashions, transmit stresses to the jambs, header, or floor of the building structure proximate to the door. These existing wind-resistant systems have all embodied sufficient limitations and/or disadvantages, such that no existing structures have achieved widespread acceptance in the industry.

DISCLOSURE OF THE INVENTION

Accordingly, an object of the present invention is to provide a wind-resistant sectional overhead door wherein the door sections are tensioned by utilizing one or more of the tensile strength of the steel skins or outer steel skin, the core, and the inner substrate as may be incorporated in a door as flexible members that transfer the windimparted forces to the guide rollers, roller track, and jambs of a door opening. Another object of the present invention is to provide such a door wherein the door sections are tension loaded, and preferably pre-loaded, when the door is in the closed position. It is a further object of the present invention to provide such a door wherein the structural elements of the door are closer to the centroid of the section profile, such that the bending moment produced by wind forces acting on the door produce less compression in the door section components. Yet another object of the present invention is to provide such a door wherein the door sections retain their flexibility due to the absence of reinforcing members, which permits the door to undergo substantial elastic or flexible deformation, either outwardly or inwardly, as a result of negative or positive pressures, respectively, yet to return sufficiently close to the original configuration such as to remain operable after high wind-loading conditions.

Another object of the present invention is to provide a wind-resistant sectional overhead door wherein the wind-load components can be factory installed and shipped in the door packaging without additional packaging requirements. Yet another object of the present invention is to provide such a door that is a standard door with a separate wind-load kit that may be employed where necessary to meet requirements of building codes, which may vary due to location, even within relatively small geographic areas. Yet another object of the invention is to provide such a door having wind-load features that can be added to different door constructions to provide different levels of wind-load protection as a result of different structural characteristics of the basic doors. Still a further object of the present invention is to provide such a door wherein fewer parts are required to construct a wind-loaded door in terms of both major components and hardware, fasteners, straps, and the like. Still another object of the present invention is to provide such a door that can be installed in less time than conventional wind-load doors and reduces manpower requirements to a single installer.

Still a further object of the invention is to provide a wind-resistant sectional overhead door that is of substantially lighter weight than conventional wind-load doors, thereby resulting in reduced shipping and handling costs. Yet another object of the present invention is to provide such a door wherein the reduced weight permits the use of conventional counterbalance systems for lightweight doors. Still another object of the present invention is to provide such a door that, although employing standard track and hinges, is of substantially lesser weight than a conventional wind-load door, which results in retention of operational longevity. Yet a further object of the present invention is to provide such a door that may employ plastic rollers rather than heavy-duty steel rollers, which are conventionally employed for wind-load door configurations.

Another object of the present invention is to provide a wind-resistant sectional overhead door having a header lock that avoids stress concentrations and prevents premature buckling of the door, thereby increasing the probabilities of maintaining the integrity of a building during high winds and reducing the probabilities of the need for replacing a door in whole or in part. Still another object of the invention is to provide such a header lock for a door that is operative any time the door is closed and the components do not significantly protrude into the building space. Yet a further object of the invention is to provide such a header lock for a door that is low cost, can be factory installed on a door, and can be shipped without the necessity for additional packaging.

Yet a further object of the present invention is to provide a wind-resistant sectional overhead door that is safer in numerous particulars than conventional wind-load doors. Yet a further object of the invention is to provide such a door that is always wind-load active when it is closed and requires no action by a building occupant to prepare or activate the wind-resistant features of the door for high wind conditions. Yet a further object of the present invention is to provide such a door wherein components of the door do not protrude into the building, thus reducing risk of injury to people or damage to vehicles or other objects within the building, as well as providing more space for vehicles of larger dimensions. Yet a further object of the present invention is to eliminate the safety hazard of conventional wind-load doors produced by beams or struts, which may be misused as standing or gripping elements, particularly by adolescents. Yet a further object of the present invention is to provide such a door that avoids surges normally produced by a heavy door, which may require unsafe full force adjustment of a door operator to prevent reversal when closing the door.

In general, the present invention contemplates a wind-resistant sectional overhead door selectively moveable between an open position and a closed position relative to a door opening defined by spaced vertical jambs and a horizontal header extending therebetween including, a plurality of elongate horizontal panels pivotally connected at the top and bottom edges of adjacent of the panels, roller tracks mounted on the vertical jambs to either side of the door, roller shafts mounted at the ends of the panels, guide rollers carried by the roller shafts and engaging the roller tracks, and restraining members for limiting axial movement of the roller shafts, whereby the roller shafts and the panels are tension-loaded when the door is in the closed position to prevent buckling of the panels under applied wind forces. Another facet of the present invention contemplates a header lock for interconnecting the top panel of a sectional overhead door to the header of a door frame including, a panel bracket attached to the top panel of the door, a header bracket attached to the header of the door frame, an extending arm on the panel bracket having a curved section with a first engaging surface, a return arm on the panel bracket having a second engaging surface positioned rearwardly of the first engaging surface permitting pivotal movement of the top panel of the door relative to the header while restraining separating of the top panel from the header.

PREFERRED EMBODIMENT FOR CARRYING OUT THE INVENTION

Figure 1:
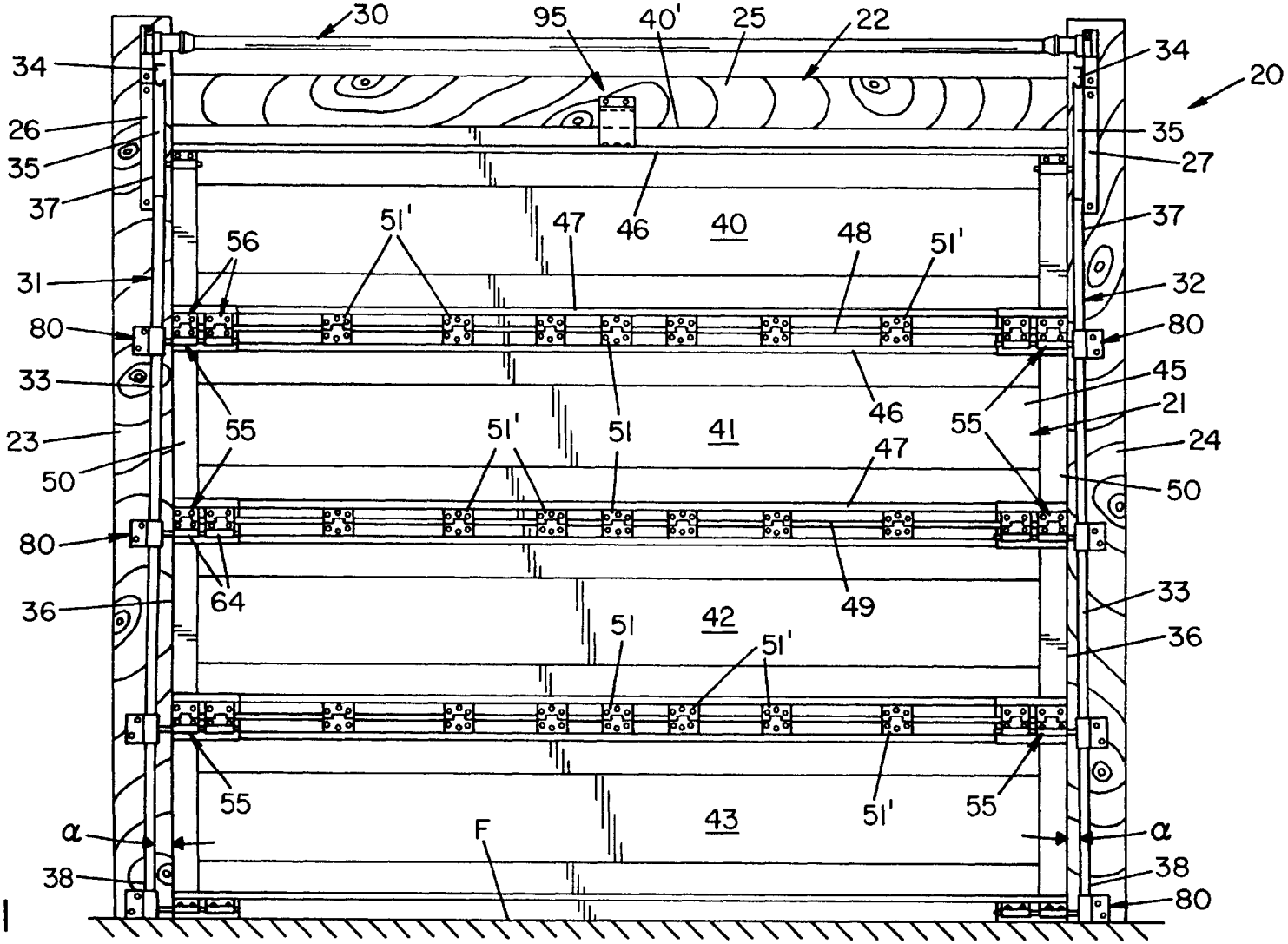
FIG. 1 is a rear-elevational view of a sectional overhead door according to the concepts of the present invention embodying wind-force-resistant features in the interface between the door and door jamb and between adjacent door panels.
Figure 2:
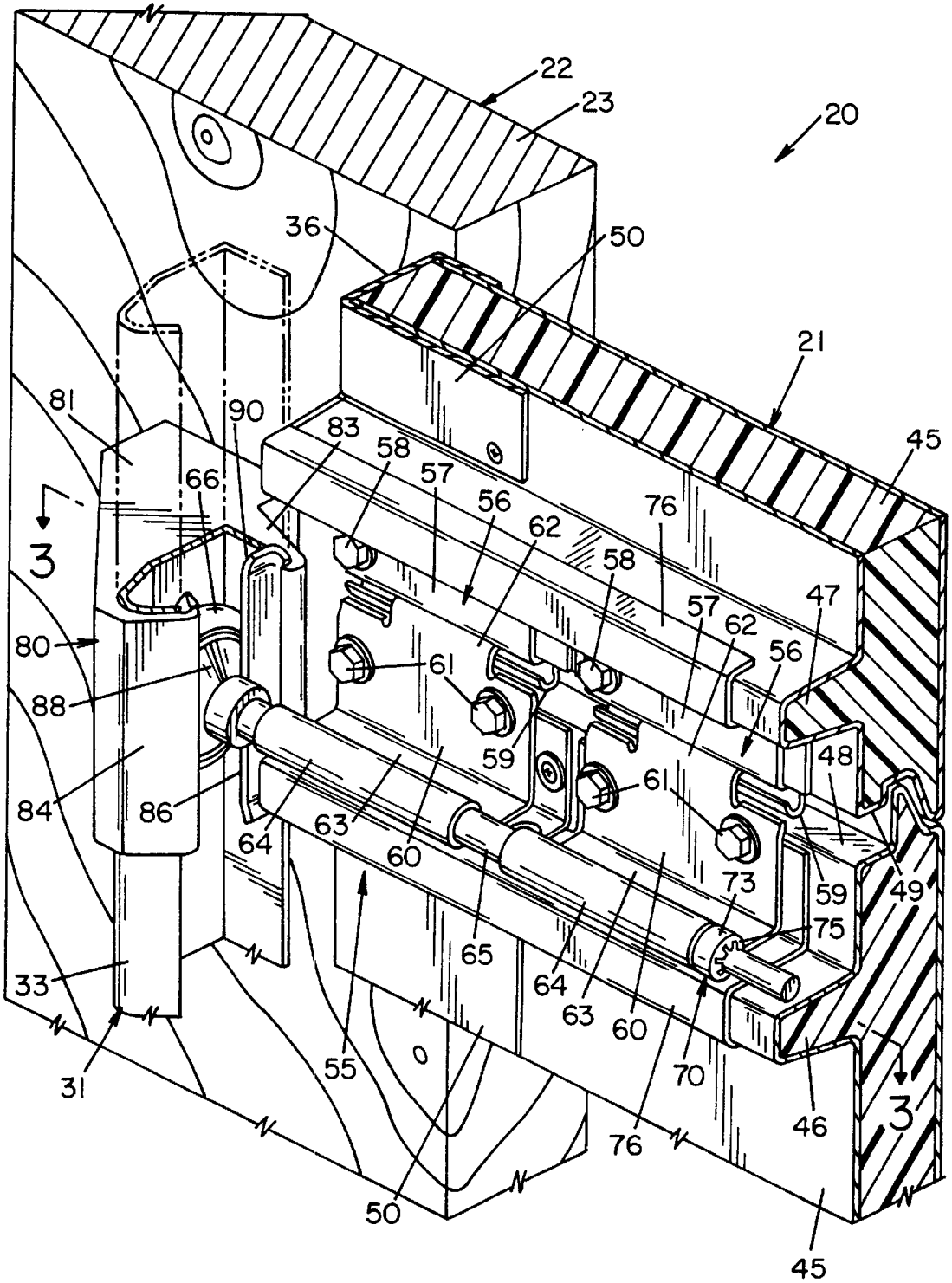
FIG. 2 is an enlarged fragmentary perspective view of the sectional overhead door of FIG. 1 showing details of the roller shaft mounting, the rollers, the roller track, and the roller track-reinforcing jamb brackets at the juncture of two adjacent panels.

A wind-resistant sectional overhead door system according to the concepts of the present invention is generally indicated by the numeral 20 in FIG. 1 of the drawings. The wind-resistant door system 20 is shown mounted in conjunction with a sectional overhead door, generally indicated by the numeral 21, of a type employed in garages for homes. It will be appreciated, however, that the wind-resistant door system 20 can readily be adapted for use with a wide variety of residential and commercial overhead doors employed in the industry.

The opening in which the door 21 is positioned for opening and closing movement relative thereto in conventional fashion is defined by a frame, generally indicated by the numeral 22. The frame 22 consists of a pair of spaced jamb members 23 and 24 that, as seen in FIG. 1, are generally parallel and extend vertically upwardly from the floor F of a building. The jambs 23, 24 are spaced and joined proximate their vertically upper extremity by a horizontal header 25 to thereby define the generally inverted U-shaped frame 22 for sectional door 21. Frame 22 is normally conventionally constructed of lumber, in a manner well known to persons skilled in the art, for purposes of reinforcement, attachment to the building structure, and to facilitate the attachment of elements involved in supporting and controlling sectional door 21.

Affixed to the jambs 23 and 24 proximate the upper extremities thereof near the header 25 and to either side of the door 21 are flag angles 26 and 27. The flag angles 26, 27 are attached to their underlying jamb members 23, 24 and may be any one of known configurations employed in the art. As shown in FIG. 1, the flag angles 26,27 may mount a counterbalance system, generally indicated by the numeral 30, that interacts with the door 21 to facilitate raising and lowering the door 21 in a manner well known to persons skilled in the art. While a counterbalance system according to Applicants' Assignee's 's U.S. Pat. No. 5,419,010 is shown for exemplary purposes in FIG. 1, it will be appreciated that any of a variety of different types of counterbalancing system may be employed, as long as interference with the structure of the wind-resistant door system 20 hereinafter described is, or can be, avoided.

The flag angles 26, 27 also partially support roller tracks 31 and 32 overlying the jambs 23 and 24, respectively, to either side of the sectional door 21. Each of the roller tracks 31, 32 include a substantially vertical leg 33, a substantially horizontal leg 34, and a transition portion 35 interposed therebetween. The roller tracks 31, 32, in a known manner, thus support and direct travel of sectional door 21 in moving from the closed, vertical position depicted in FIG. 1, associated with the vertical legs 33, 33 of roller tracks 31, 32, to the open, horizontal position associated with horizontal legs 34, 34 of roller tracks 31, 32.

While the vertical legs 33 of roller tracks 31, 32 are normally substantially vertical and parallel to the ends 36 of sectional door 21, save for being slightly outwardly inclined from bottom to top in order to seat the door relative to frame 22 at closure, it is a feature of the present invention that vertical legs 33 of roller tracks 31, 32 are also positioned at an oblique angle a with respect to the door ends 36 (FIG. 1). As shown, placement of vertical legs 33 at oblique angle a places the upper extremities 37 of vertical legs 33 closest to door ends 36, the length of vertical legs 33 downwardly of the upper extremities 37 being at progressively greater distances outwardly of the ends 36 of door 21, and the lower extremities 38 of vertical legs 33 being at the greatest distance from door ends 36. The angle a is normally in the range of ¼ to 2 degrees and, in most instances, approximately ¾ to 1 degree.

For exemplary purposes, a four-panel sectional door 21 is shown in the drawings; however, it will be appreciated by persons skilled in the art that five, six, or more panels may be employed in sectional doors of this type, depending upon the height of the door opening and related considerations. As depicted, the sectional door 21 consists of a top panel 40, an upper middle panel 41, a lower middle panel 42, and a bottom panel 43. Each of the panels 40–43 may have essentially the same configuration, including a body portion 45, a upper rib or strut 46, and a lower rib or strut 47. Upper struts 46 are spaced a distance below the upper edge 48 of the panels 40–43, while lower struts 47 are spaced a distance above the lower edges 49 of the panels 40–43. The sectional door 21 has ends 36, which are defined by end caps 50, positioned at each end of each of the panels 40–43. The panel edges 48,49 may be of any standard configuration or may incorporate an antipinch feature of the type disclosed in Applicants' Assignee's U.S. Pat. No. 5,522,446. Adjacent of the panels 40–43 are medially interconnected by one or more center hinges 51, as depicted between upper middle panel 41 and lower middle panel 42 at edges 49 and 48, respectively.

Sectional door 21 interrelates with roller tracks 31, 32 and respective jamb members 23, 24 through guide roller assemblies, generally indicated by the numeral 55 in FIGS. 1–4 of the drawings. As guide roller assemblies 55 may be structurally identical (or a mirror image) to either side of the door 21 and between the various panels 40–43, only one is detailed as exemplary in FIGS. 2–4. Guide roller assemblies 55 have two adjacent roller mounting hinges 56 at the longitudinal extremities of each of the panels 40–43. The roller mounting hinges 56 each have a first leaf 57 attached to the rear of panel body 45 as by fasteners 58, which may be screws, bolts, rivets, or other elements, depending upon the material or materials of panel body 45 and end cap 50. The first leaf 57 of hinges 56 has a cylindrical knuckle 59 projecting downwardly toward the adjacent lower panel.

Roller mounting hinges 56 each have a second leaf 60 mounted proximate the upper edge 48 of each of panels 40–43 on the rear of panel body 45. Each second leaf 60 is affixed by suitable fasteners 61 comparable to fasteners 58. Each second leaf 60 has a projecting knuckle 62 that is attached to, and freely pivotally interengages, knuckle 59 of first leaf 57. As constituted, the first leaf 57 and second leaf 60 of hinges 56 do not require a hinge pin due to the configuration of knuckles 59, 62.

One of the first leaf 57 or second leaf 60 has a projecting arm 63 that mounts a cylindrical sleeve 64. The cylindrical sleeves 64 of roller mounting hinges 56 depicted in FIGS. 2–4 support roller shafts 65 while permitting axial movement of shafts 65 relative to the cylindrical sleeves 64. The outboard end of each roller shaft 65 carries a guide roller 66 that moves within the roller track 31.

Figure 3:
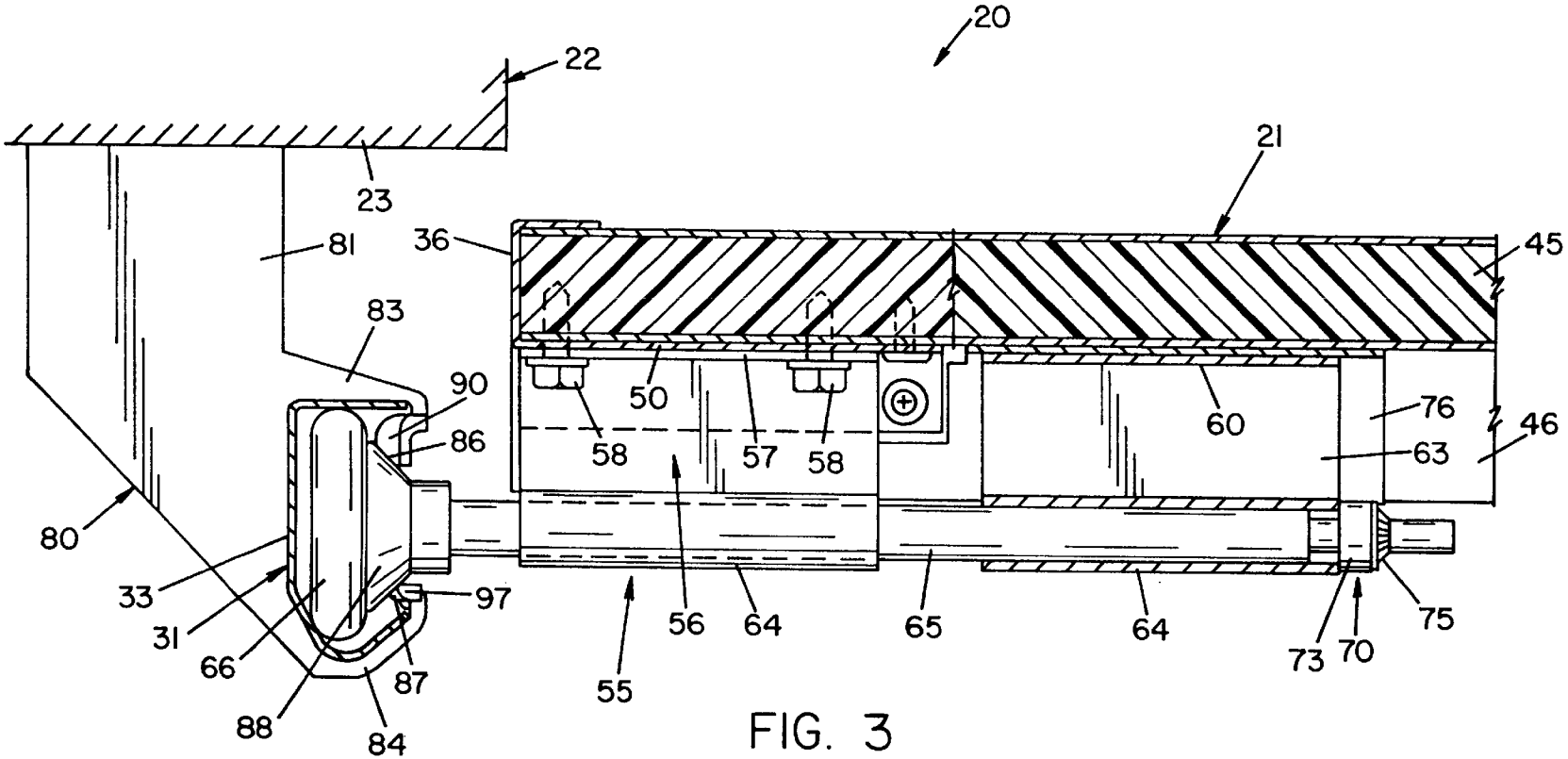
FIG. 3 is a fragmentary plan view, partially in section, taken substantially along the line 3—3 of FIG. 2 showing further details of the components of FIG. 2.
Figure 17:
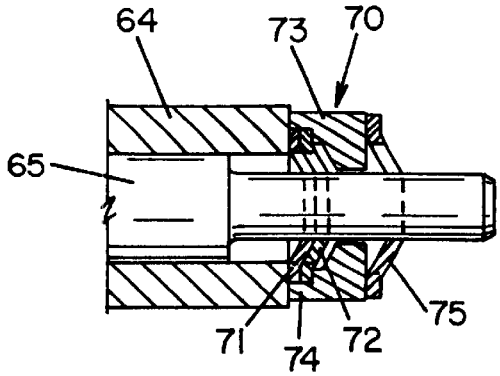
FIG. 17 is an enlarged sectional view of the shaft restraining assembly of the sectional overhead door of FIG. 1 taken substantially along the line 17—17 of FIG. 3.

The extremity of roller shaft 65 opposite the guide roller 66 and inboard of cylindrical sleeves 64 of roller mounting hinges 56 carries a shaft restraining assembly, generally indicated by the numeral 70. The shaft restraining assembly 70, as best seen in FIGS. 3 and 17, controls the extent of movement of roller shaft 65 and, thus, guide roller 66 axially outwardly of the door 21. As shown in its preferred form, the shaft restraining assembly 70 consists of a first Tinnerman nut 71 that engages the inboard cylindrical sleeve 64 to limit axial outward movement of roller shaft 65. The first Tinnerman nut 71 is backed up by a second Tinnerman nut 72 to essentially effect a locking of the nut 71 in any desired position along the roller shaft 65. A cylindrical retainer 73 having an axially projecting collar 74 overlies the first and second Tinnerman nuts 71, 72 to prevent their radial expansion and axially restrains the second Tinnerman nut 72 from movement along roller shaft 65. A third Tinnerman nut 75 is positioned inboard of the cylindrical retainer 73 to maintain it in position axially of roller shaft 65 and overlying Tinnerman nuts 71, 72. It is to be appreciated that the shaft restraining assembly 70 could take the form of a threaded roller shaft 65 with a nut that might have a locking feature to provide suitable adjustment and locking in a desired position.

With the utilization of shaft restraining assembly 70 and the oblique orientation of the vertical legs 33 of roller tracks 31 and 32, the door 21 may be placed in tension employing a conventional guide roller 66 and conventional roller tracks 31. In such instance, the shaft restraining assemblies 70 at each of the guide rollers 66 are adjusted with the door 21 in the closed position to place roller shafts 65 in tension. This tension loads the sectional door 21 through the length of each of the panels 40–43, through the roller shafts 65, guide rollers 66, and vertical legs 33 of roller tracks 31, 32 to the jamb members 23, 24 to either side of sectional door 21. With the shaft restraining assemblies 70 all thus adjusted, the door 21 is tensioned on all occasions when it assumes the closed position depicted in FIG. 1, yet guide rollers 66 and roller shafts 65 are free to move axially inwardly to adjust to the angular positioning of the vertical track 33 as soon as the door 21 commences movement vertically upwardly from the closed position. While the utilization of two side-by-side roller mounting hinges 56 to support roller shafts 65, as depicted in FIGS. 1–4, is advantageous in transferring forces to a greater surface area on sectional door 21, it is to be appreciated that for less stringent wind-force conditions, a single roller-mounting hinge 56 may be provided to support each of the roller shafts 65.

On the other hand, enhanced force transfer between sectional door 21 and roller shaft 65 may be effected by employing strut caps 76 that overlie the upper strut 46 and lower strut 47 and the rear surface of panel body 45 in the area where roller mounting hinges 56 are mounted on the door 21. It will also be appreciated that in lieu of two separate adjacent hinges, an elongate hinge configuration covering an expanded surface area on door 21 could achieve similar results in terms of stress transfer between door 21 and roller shaft 65.

Figure 4:
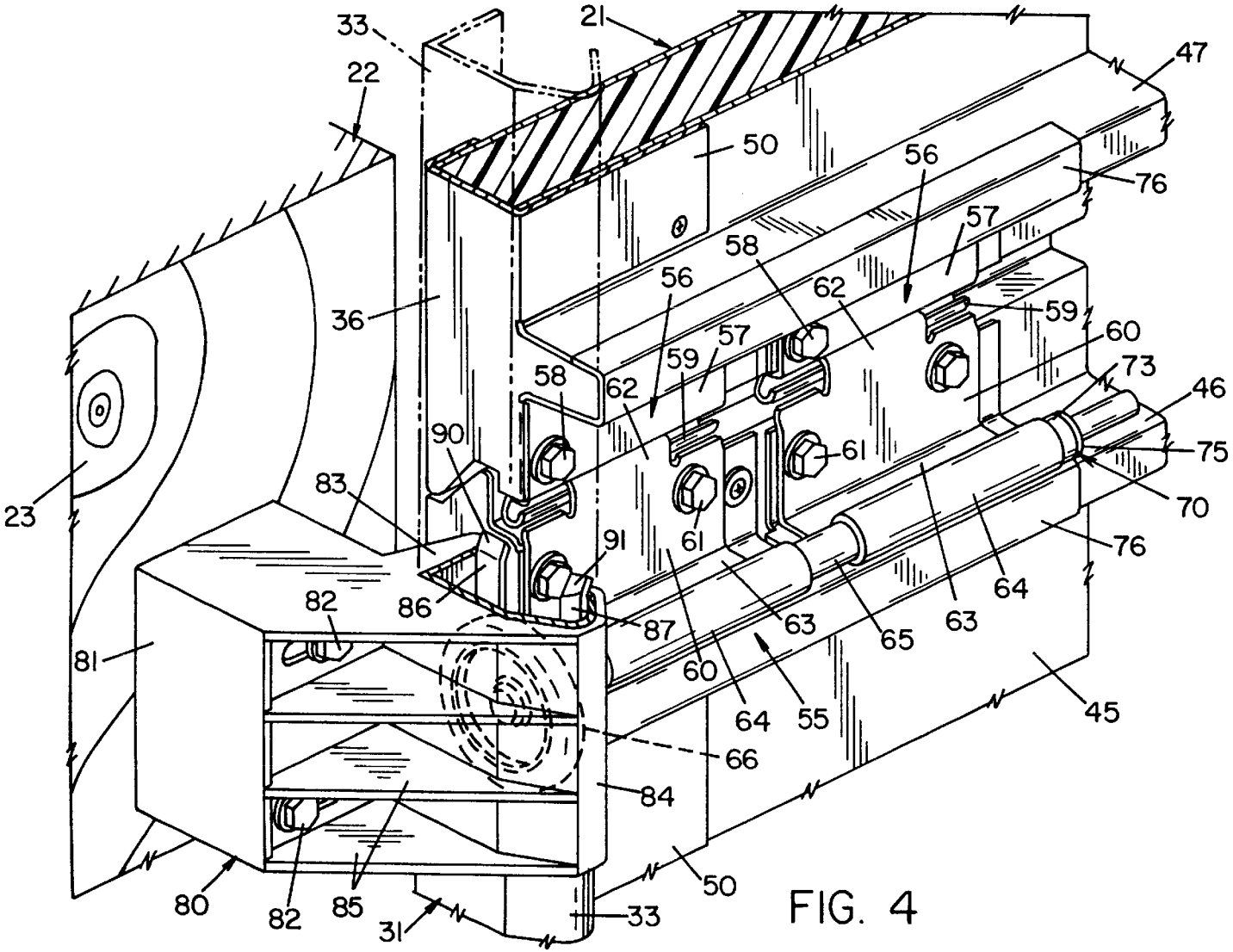
FIG. 4 is an enlarged fragmentary perspective view of the sectional overhead door of FIG. 1 showing details of the structure of FIG. 2 from a different vantage.

While conventional roller tracks and jamb brackets may be employed for lighter wind loading requirements, it may be advantageous for somewhat more stringent wind load requirements to employ roller tracks made of heavier gauge materials. To achieve even higher levels of performance, door system 20 may be provided with track reinforcing jamb bracket assemblies, as generally indicated by the numeral 80 in FIGS. 2–4 of the drawings. As best seen in FIGS. 3 and 4, a track reinforcing jamb bracket assembly 80 is shown in conjunction with a vertical leg 33 of a standard J-shaped roller track 31. The track reinforcing jamb bracket assembly 80 has a box-like base 81, which is shown attached to jamb member 23 by a plurality of fasteners 82 providing a secure mounting to the jamb member 23. The jamb bracket assemblies 80 have an inner arm 83 and an outer arm 84, which preferably fully encompass roller track 31 in a portion of vertical leg 33 where the roller 66 is positioned when the door 21 is in the closed position. The outer arm 84 is supported from the base 81 by a plurality of ribs 85 serving to reinforce the jamb bracket assemblies 80.

The extremities of the arms 83 and 84 have an inner ramp 86 and an outer ramp 87, respectively, that extend inwardly of the roller tracks 31 and outwardly of the door 21. The roller shaft 65 has a beveled collar 88 adjacent guide roller 66 that matingly engages the inner ramp 86 and outer ramp 87. The beveled collar 88 may be a separate component from guide roller 66 or may be formed integrally therewith. The upper extremities of ramps 86 and 87 are provided with an inner incline 90 and an outer incline 91, respectively, that progress from alignment with roller track 31 outwardly of door 21 onto the ramps 86, 87. Thus, as the rollers 66 approach the closed position of sectional door 21, the beveled collar 88 rides outwardly on the inclines 90, 91 and onto the ramps 86, 87. The shaft restraining assembly 70 is adjusted, such that when the beveled collar 88 reaches the ramps 86, 87, the shaft 65 is tensioned to the extent desired to place the panels 40–43 of sectional door 21 in a selected degree of pretensioning. The track reinforcing jamb bracket assembly 80 prevents distortion of roller track 31 it encloses due to the surrounding arms 83, 84, even under extreme loading conditions which may be applied to sectional door 21, with the forces being transferred to the jamb 23. With the track reinforcing jamb bracket assemblies 80 mounted between each of panels 40–43 at each of the door ends 36, the door 21 may be tensioned over substantially its entire surface to transmit forces applied to door 21 substantially uniformly to the jamb members 23, 24. In lieu of the vertical legs 33 of roller tracks 31, 32 being positioned at an angle $\alpha$ to ends 36 of door 21, the legs 33 may parallel the door ends 36, and the ramps 86 and 87 of progressively lower jamb bracket assemblies 80 may be angularly oriented and progressively downwardly displaced further from the ends 36, such as to lie along a line at oblique angle $\alpha$.

In a door configuration designed for withstanding higher pressures in incorporating the totality of the features thus far described, it may prove to be advantageous to provide supplemental center hinges 51' at the edges 48, 49 between the panels 40–43, as seen in FIG. 1. Additional supplemental hinges 51' may be located substantially equidistant along the length of the panels 40–43. Alternatively, a closer longitudinal spacing may be provided between supplemental hinges 51' in the area of the longitudinal center of the door panels 40–43, as is depicted in FIG. 1 of the drawings, to concentrate additional support in areas displaced the greatest distance from the door ends 36.

Figure 7:
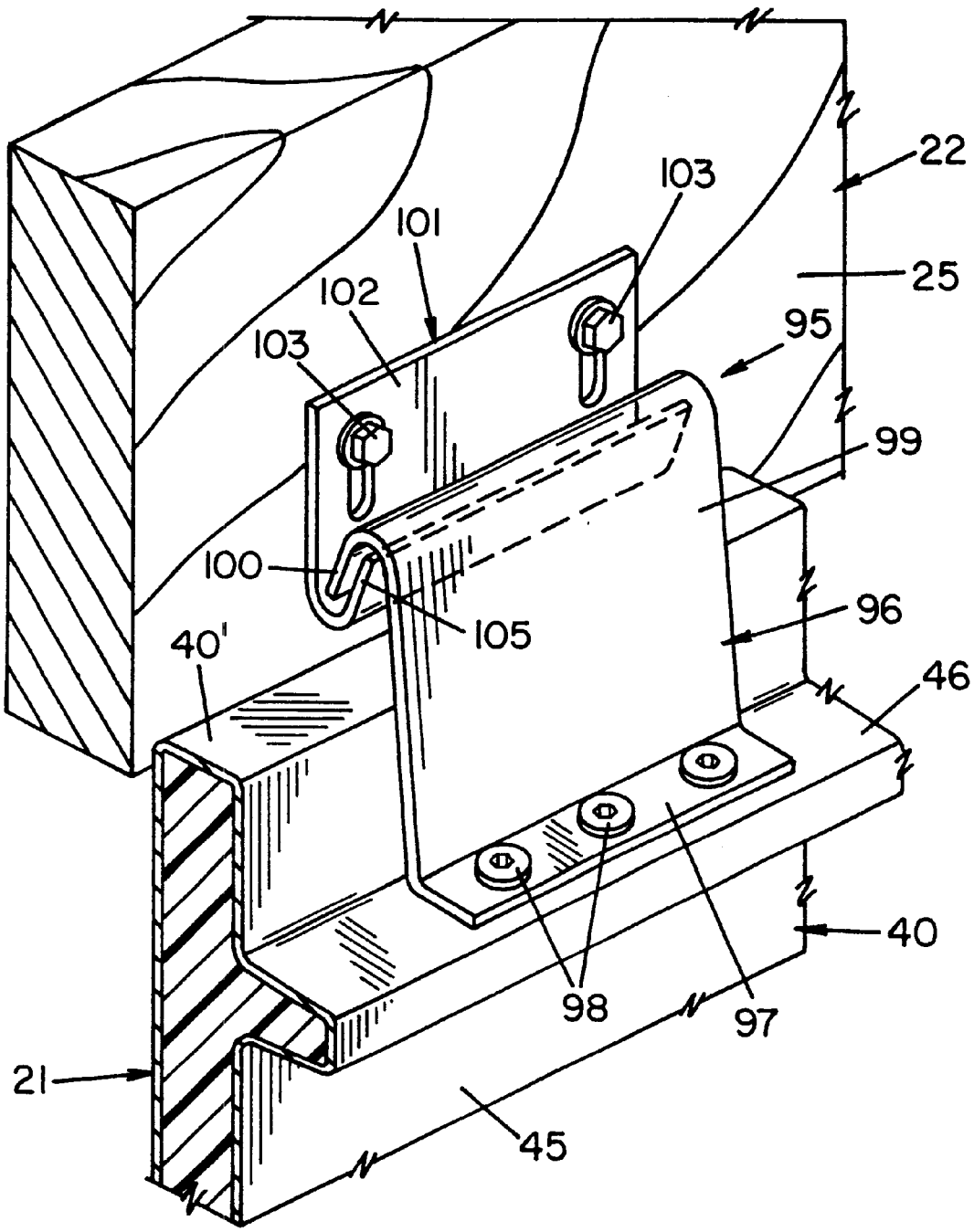
FIG. 7 is an enlarged perspective view of the header lock of FIG. 1 with the sectional overhead door in the closed position.

Depending on the construction features of a particular door and the installation, there may be instances where premature failure of a sectional door 21 can take place due to separation between top panel 40 and the adjacent header 25, particularly as a door bows inwardly under positive pressure acting on the exterior surface of a door 21. In such instances, it may be advantageous to provide one or more header lock mechanisms, generally indicated by the numeral 95 in FIGS. 1 and 7. While a single header lock mechanism 95 is positioned medially of top panel 40, as depicted in FIG. 1, it will be appreciated that two or more header locks 95 appropriately spaced along the length of top panel 40 may be desirable to meet more stringent wind force requirements. As shown, the header lock mechanism 95 consists of a panel bracket 96 that has an attachment plate 97 affixed to the top edge 40' of top panel 40, as by a plurality of fasteners 98. Panel bracket 96 also has an extension arm 99 extending upwardly of top panel 40 and terminating in a downwardly-turned engaging surface 100. The header lock mechanism 95 has a header bracket 101 having an attachment plate 102 that is adjustably vertically positioned on header 25 by a plurality of fasteners 103. Header bracket 101 extends downwardly from attachment plate 102 into a U-shaped return and an engaging surface 105 that lies rearwardly of, but substantially paralleling, engaging surface 100 of panel bracket 96. The brackets 96, 101 are preferably positioned so that engaging surfaces 100 and 105 are proximate to but spaced from each other a small distance, such that engaging surface 100 may move into overlapping relation with engaging surface 105 as the door 21 closes without interfering engagement. It will be appreciated that separation of top panel 40 from header 25 under extreme wind loading would be generally inwardly and somewhat downwardly so as to be substantially normal to the plane of engaging surface 105 and engaging surface 100. Thus, separation of the top panel 40 from the header 25 may be limited, such as to preclude premature failure of door 21 by the presence of one or more header lock mechanisms 95.

Figure 5:
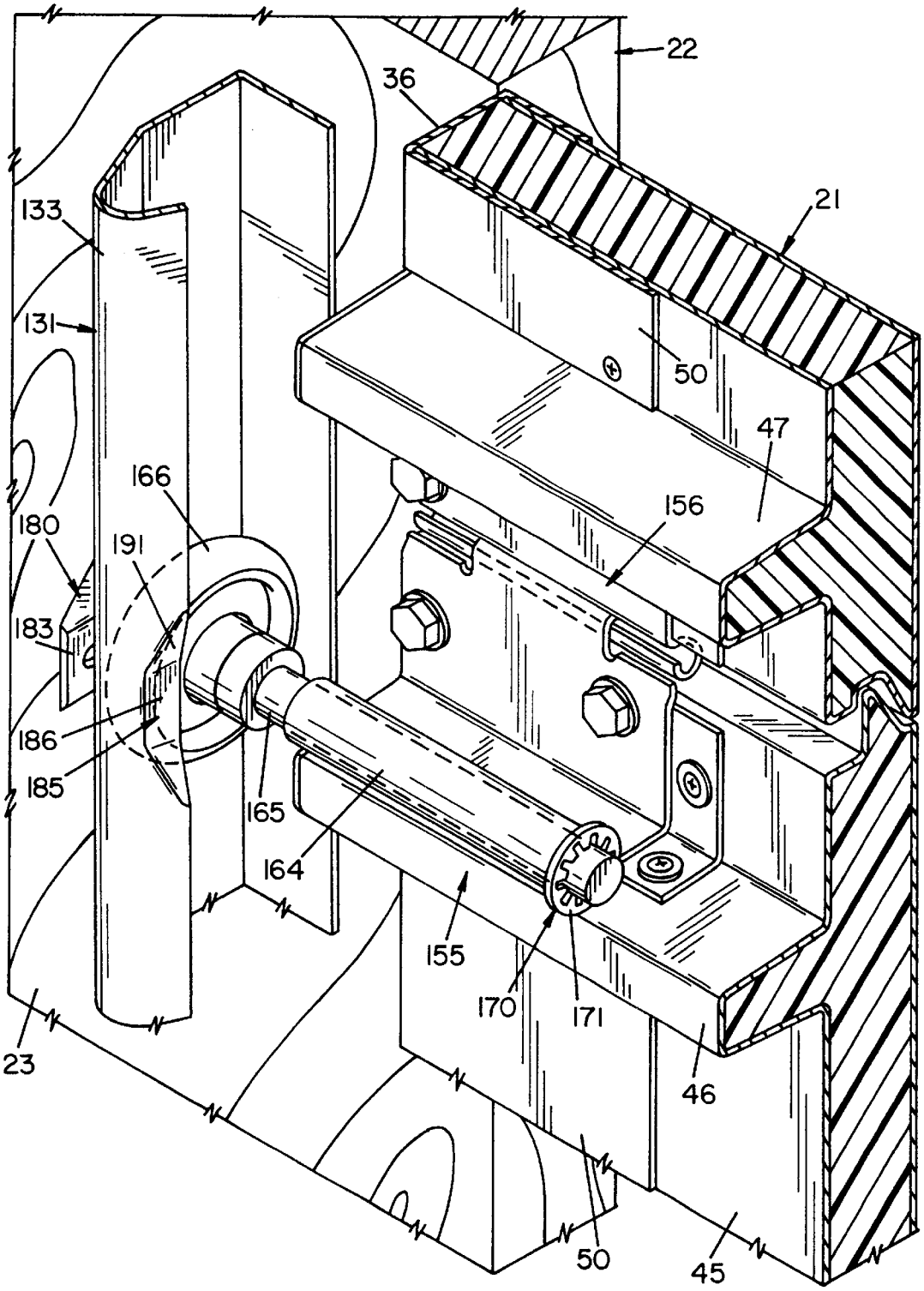
FIG. 5 is a view similar to FIG. 2 showing an alternate form of roller shaft mounting, rollers, and roller track for the sectional overhead door of FIG. 1.
Figure 6:
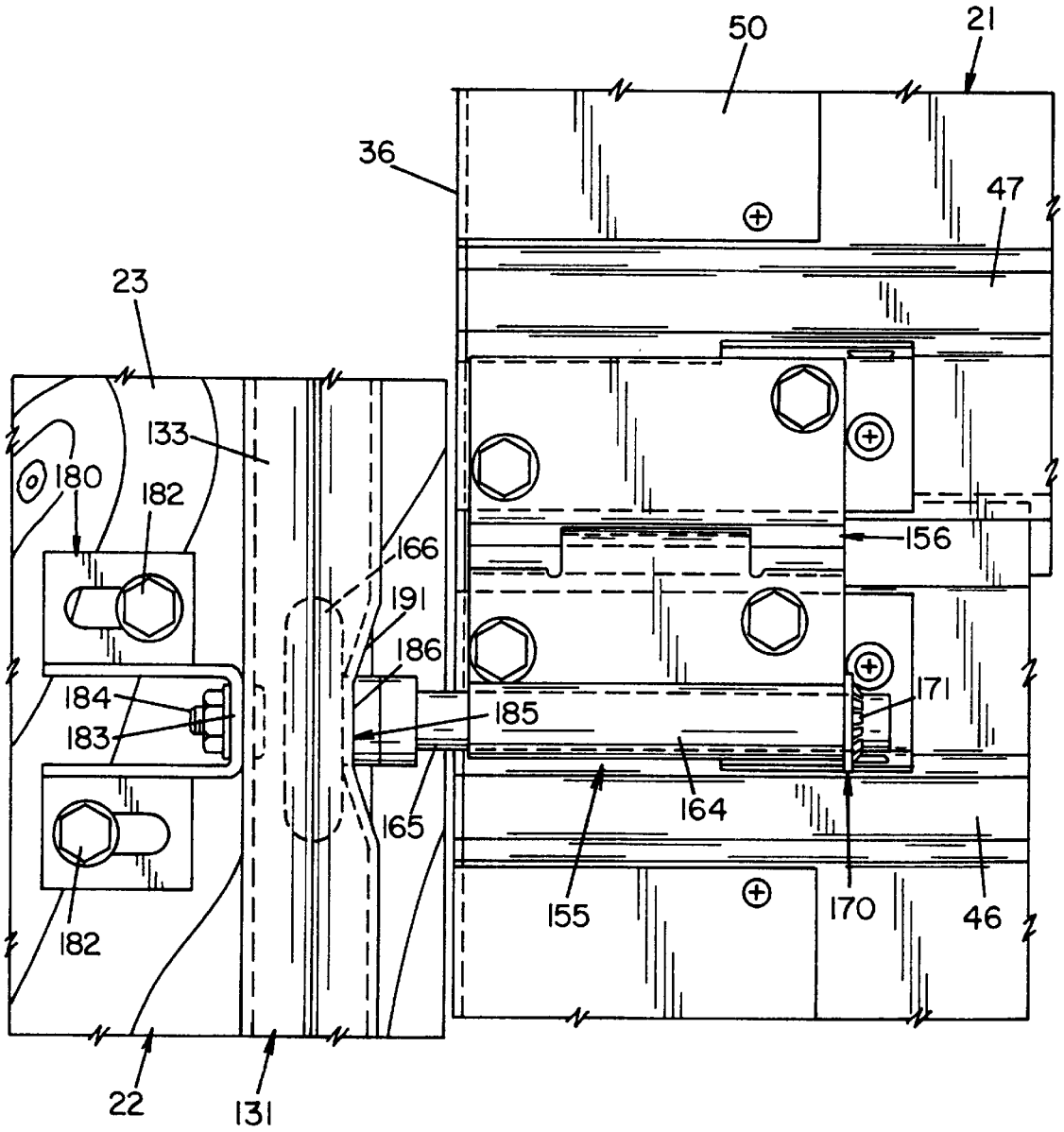
FIG. 6 is a rear-elevational view of the alternate form of roller shaft mounting, rollers, and roller track shown in FIG. 5.

An alternate form of roller shaft mounting, rollers, and roller track for the sectional overhead door 21 of FIG. 1 is depicted in FIGS. 5 and 6 of the drawings and is designed to accommodate less stringent wind-load conditions than the form depicted and described above in conjunction with FIGS. 1–4 of the drawings. In this instance, the guide roller assemblies, generally indicated by the numeral 155, employ only a single rollermounting hinge 156. The roller-mounting hinge 156 may be constructed identical to the roller mounting hinges 56 detailed hereinabove in conjunction with the description of FIGS. 1–4 of the drawings. In this instance, the cylindrical sleeve 164 supports roller shafts 165, which permits axial movement of the shafts 165 relative to the sleeves 164. The outboard end of each roller shaft 165 carries a guide roller 166, which may be of a conventional configuration. The guide rollers 166 move within roller track 131, which may be identical to the roller track 31 described hereinabove, with the exception hereinafter noted. The extremity of roller shaft 165 opposite the guide roller 166 and inboard of cylindrical sleeve 164 of roller-mounting hinge 156 carries a shaft restraining assembly, generally indicated by the numeral 170. The shaft restraining assembly 170 controls the extent of movement of roller shaft 165 and, thus, guide roller 166 axially outwardly of the door 21. In this instance, the shaft restraining assembly 170 consists of a single Tinnerman nut 171 that engages the cylindrical sleeve 164 to limit axial outward movement of roller shaft 165. The Tinnerman nut 171 or other fastening device is variably positioned axially of roller shaft 165 by moving the Tinnerman nut 171 to a selected position.

With utilization of the shaft restraining assembly 170 and the oblique orientation of vertical legs 133 of roller tracks 131 and 132, the door 21 may be tensioned by employing a guide roller 166 and roller tracks 131. In such instance, the shaft restraining assemblies 170 are adjusted at each of the guide rollers with the door in the closed position to place roller shafts 165 in tension. This tension loads the sectional door 21 through the length of each of the panels, through roller shafts 165, guide rollers 166, and vertical legs 133 of roller tracks 131, 132 to the jamb members 23, 24 to either side of sectional door 21. In this instance, the transfer of forces from vertical leg 133 of roller track 131 may be by conventional jamb brackets assemblies 180, which are affixed to jamb members 23, 24 by a plurality of fasteners 182. Jamb bracket assemblies 180 have an outwardly extending arm 183 that is attached to roller track 131 by a fastener 184. The jamb bracket assemblies 180 are preferably positioned proximate to guide rollers 166 when the door 21 is in the closed position to facilitate the direct transfer of forces from roller tracks 131, 132 to jamb members 23, 24.

In this instance, roller track 131 and vertical leg 133 may have depressions 185 formed in the hook portion of the J shape located at the position of rollers 166 when the door 21 is in the closed position and opposite the jamb brackets assemblies 180. The depressions 185 have an outer ramp 186 and an outer incline 191 leading thereto that rides the rollers 166 axially outwardly of door 21 as the rollers 166 approach the closed position of sectional door 21.

While this alternate form is designed for lesser wind-loading conditions, its windresisting characteristics can be improved by providing supplemental center hinges, header locks, and other features described in conjunction with FIGS. 1–4 above. It will, however, be evident that this alternate form achieves the basic tensioning advantages for a door 21, as described hereinabove.

A wind-resistant sectional overhead door system according to the concepts of an alternate embodiment of the invention is generally indicated by the numeral 220 in FIGS. 8–13 of the drawings. The door system 220 employs a frame and door and flag angle configurations, as well as a counterbalance system, which may be in accordance with the corresponding components discussed in the embodiment of the invention of FIGS. 1–7 described hereinabove.

Figure 8:
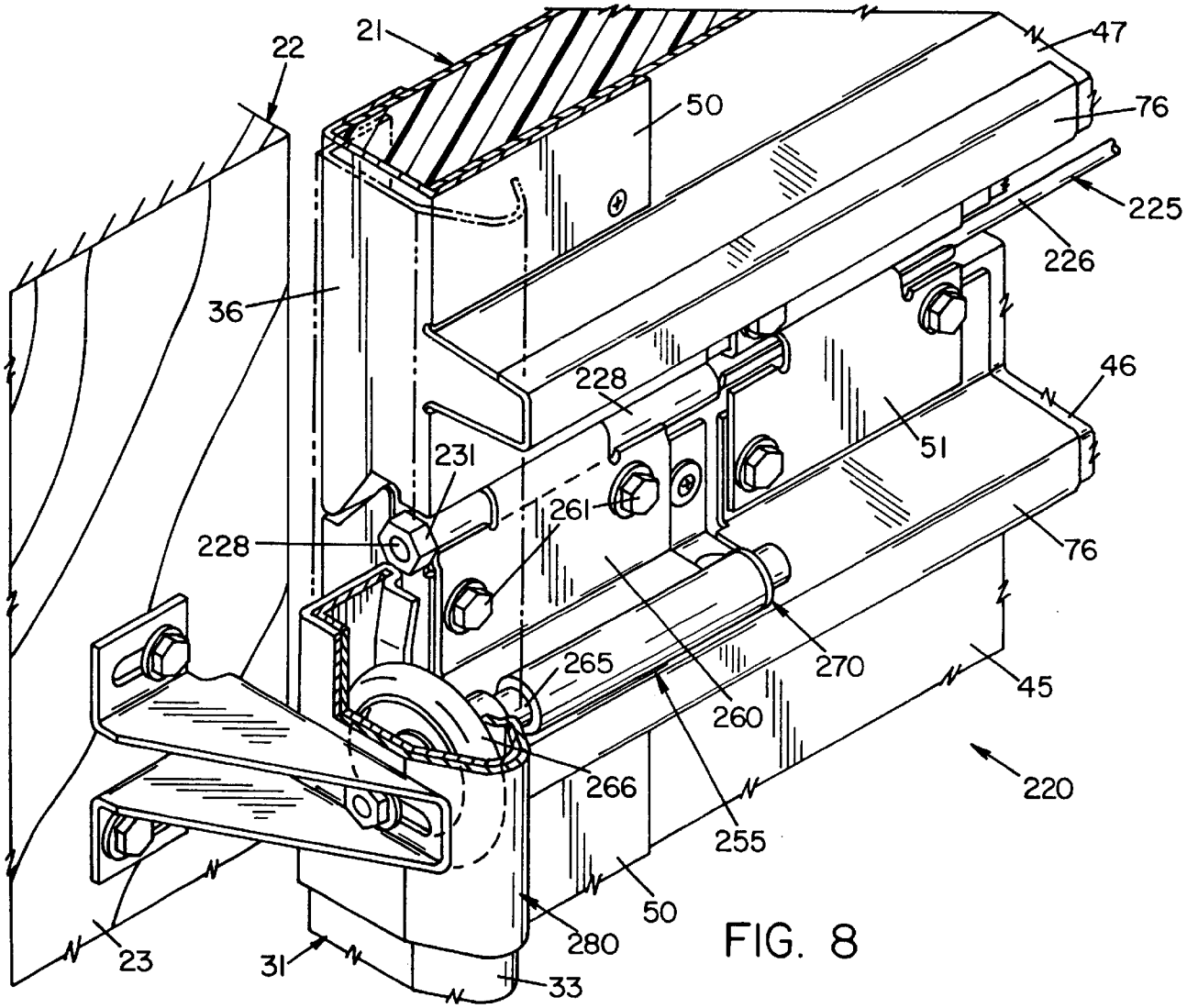
FIG. 8 is a side perspective view similar to FIG. 4 of a first alternate embodiment of a sectional overhead door according to the concepts of the present invention employing tension rod assemblies extending the length of the door sections and interacting with the door frame through the rollers, track, and roller track reinforcing jamb brackets.
Figure 9:
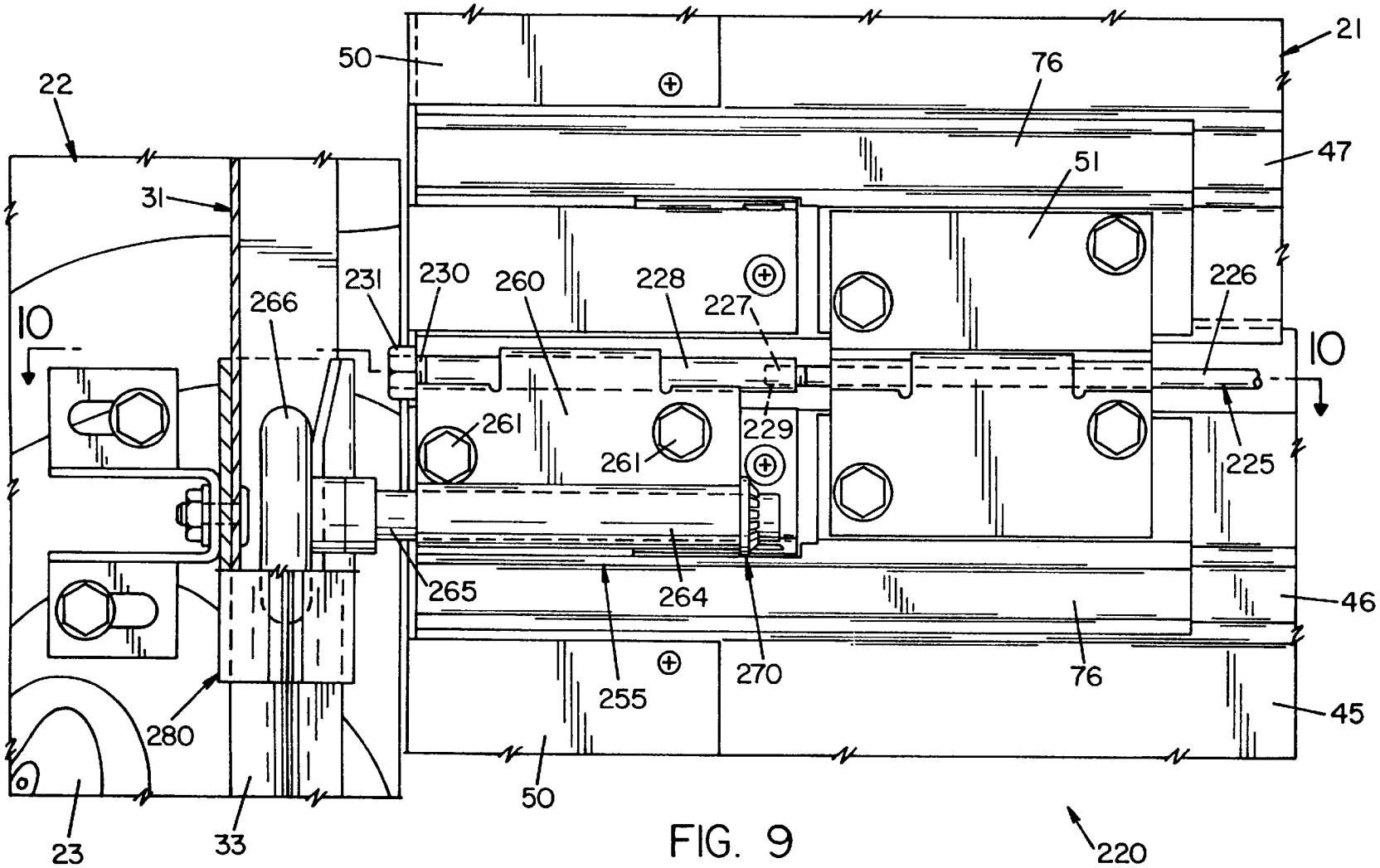
FIG. 9 is a rear-elevational view of the alternate embodiment of the sectional overhead door of FIG. 8.
Figure 10:
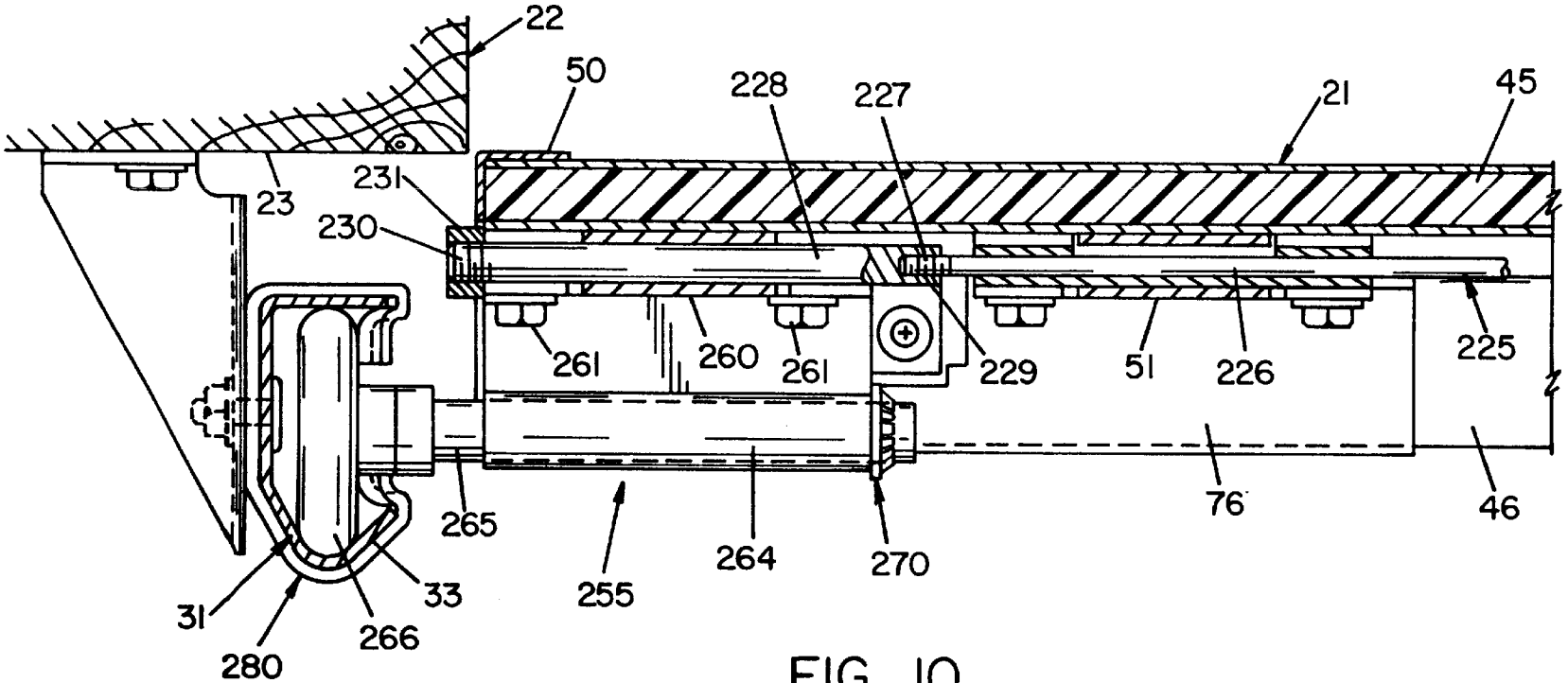
FIG. 10 is a plan view, partially in section, of the alternate embodiment of sectional overhead door taken substantially along the line 10—10 of FIG. 9.

As best seen in FIGS. 8–10, the wind-resistant door system 220 employs a plurality of tension rod assemblies, generally indicated by the numeral 225, that supplement the door panels 40–43 in transferring forces induced by wind velocity pressures to the frame of a sectional door 21. The tension rod assemblies 225 consist of through rods 226 that preferably extend somewhat less than the length of the panels 40–43. The through rods 226 may be either a solid rod or a cable of suitable dimensions to withstand the tension loading requirements for a particular door configuration. Referring particularly to FIG. 10, the through rods 226 have exteriorly-threaded ends 227 for engagement with internal threads 229 of end connector rods 228. The ends of end connector rods 228 opposite the internal threads 229 have external threads 230 for receiving a tensioning nut 231, or other fastener preferably having a locking feature, which may be adjusted to suitably pretension the through rods 226 and end connector rods 228 at the extremities thereof.

The through rods 226 may conveniently extend through the hollow knuckles of the center hinges 51 positioned along the length of the panels 40–43 as described above. As shown in FIGS. 8–10, roller mounting brackets, generally indicated by the numeral 255, are mounted at the edges of panels 40–43 overlying the end caps 50. While roller mounting hinges 56 could be employed, the roller mounting brackets 255 have only a second leaf 260 attached to the panels 40–43 as by fasteners 261. As seen in FIGS. 9 and 10, the tensioning nuts 231 engage the outer edge of the roller mounting brackets 255, such that stresses from the tension rod assemblies 225 are transferred to the roller mounting brackets 255.

The roller mounting brackets 255 have conventional cylindrical sleeves 264 that carry roller shafts 265. The roller shafts 265 are provided with shaft restraining assemblies, generally indicated by the numeral 270, which may be identical to the shaft-restraining assemblies 170 described above in conjunction with FIGS. 5 and 6. The roller shafts 265 have guide rollers 266, which may be of conventional configuration. The guide rollers 266 transfer forces to the roller tracks 31 as by track reinforcing jamb bracket assemblies 280 seen in FIGS. 8–10, which may be substantially identical to the track reinforcing jamb bracket assemblies 80 described in conjunction with FIGS. 1–4 above. Alternatively, a track reinforcing jamb bracket assembly may be employed which is in accordance with track reinforcing jamb bracket assemblies 180 described in conjunction with FIGS. 5 and 6 of the drawings. In the instance of usage of either of the track reinforcing jamb bracket assemblies 280 or 180, the forces transmitted to roller mounting brackets 255 through tension rod assemblies 225 are thus transmitted through roller shafts 265, guide rollers 266, track reinforcing jamb bracket assemblies 280 or 180, and, thus, to the door frame 22 when the door 21 is in the closed position and when wind-velocity forces acting upon the sectional door 21 are transferred to the wind-resistant sectional overhead door system 220.

Figure 11:
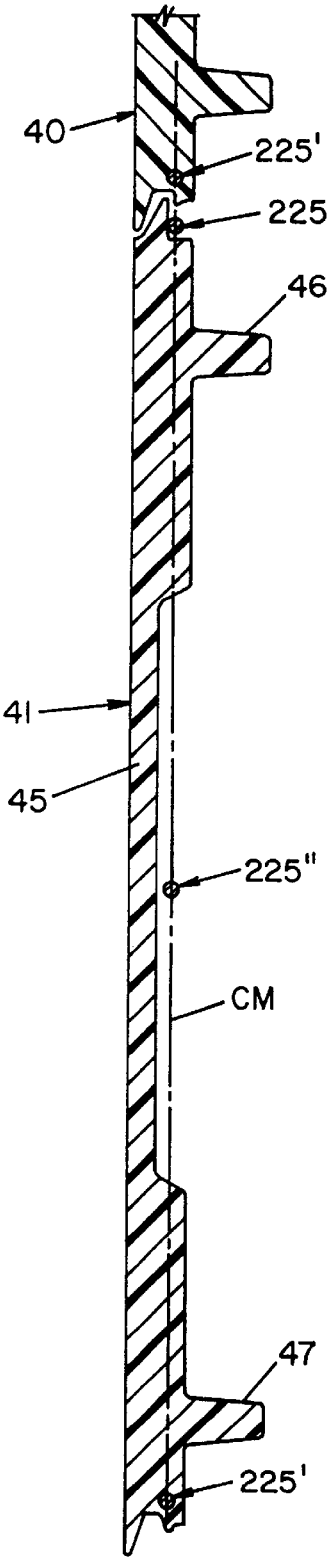
FIG. 11 is a diagrammatic, cross-sectional view of the door sections of the alternate embodiment of sectional overhead door of FIG. 8 showing an exemplary placement of the tension rod assemblies that extend the length of the door sections.
Figure 13:
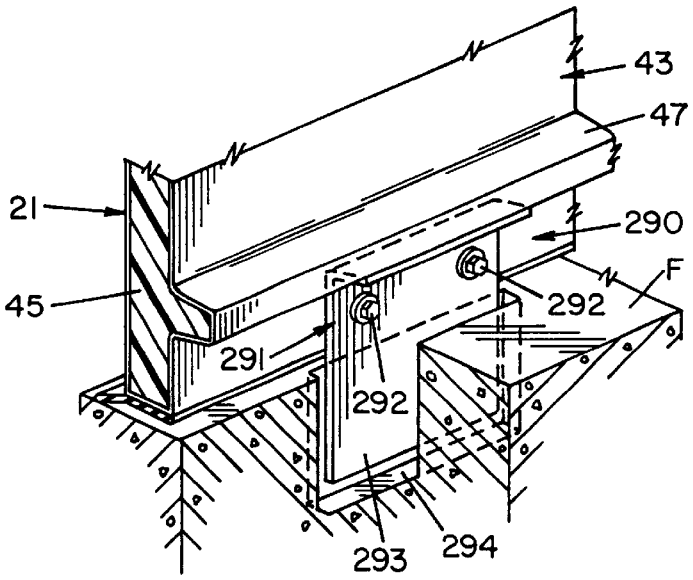
FIG. 13 is a perspective view of a door according to the alternate embodiment of sectional overhead door of FIG. 8 showing the use of a cleat mounted on the bottom of the bottom section of the door and adapted to engage a receiver in the garage floor when the door is closed.

While FIGS. 8–10 depict tension rod assemblies 225 installed in the area of the center hinges 51 between adjacent of the panels 40–43, multiple tension rod assemblies 225 may be installed in each of the panels 40–43. As seen in FIG. 11 of the drawings, a tension rod assembly 225 is installed through the hinge area at the top of panel 41; a tension rod assembly 225', proximate the lower edge of panel 41; and a tension rod assembly 225" is positioned medially of or proximate to the vertical center of the panel 41. Besides the vertical spacing, it is significant that the tension rod assemblies 225, 225', and 225" be located at or as near as possible to the centroid or geometric mass center CM of the lateral thickness of the profile of panels 40–43. This is significant to maintain the tension rod assemblies 225 under tension loading so as to achieve maximum resistance to wind-velocity pressures in both the positive pressure direction, which is normally considered towards the inside of the garage, and the negative pressure direction, which is opposite or away from the inside of the garage. In the case of tension rod assemblies 225' and 225" positioned other than at the hinge locations, these assemblies may be tensioned through the end stiles and end caps 50 so that the loads are transferred to the roller mounting brackets 255 and thence to the door frame 22. These tension rod assemblies 225' and 225" may be installed through the stiles or muntins in the door 21 or can be contained in a preformed groove extending the length of the inner skin of the panels 40–43.

Figure 12:
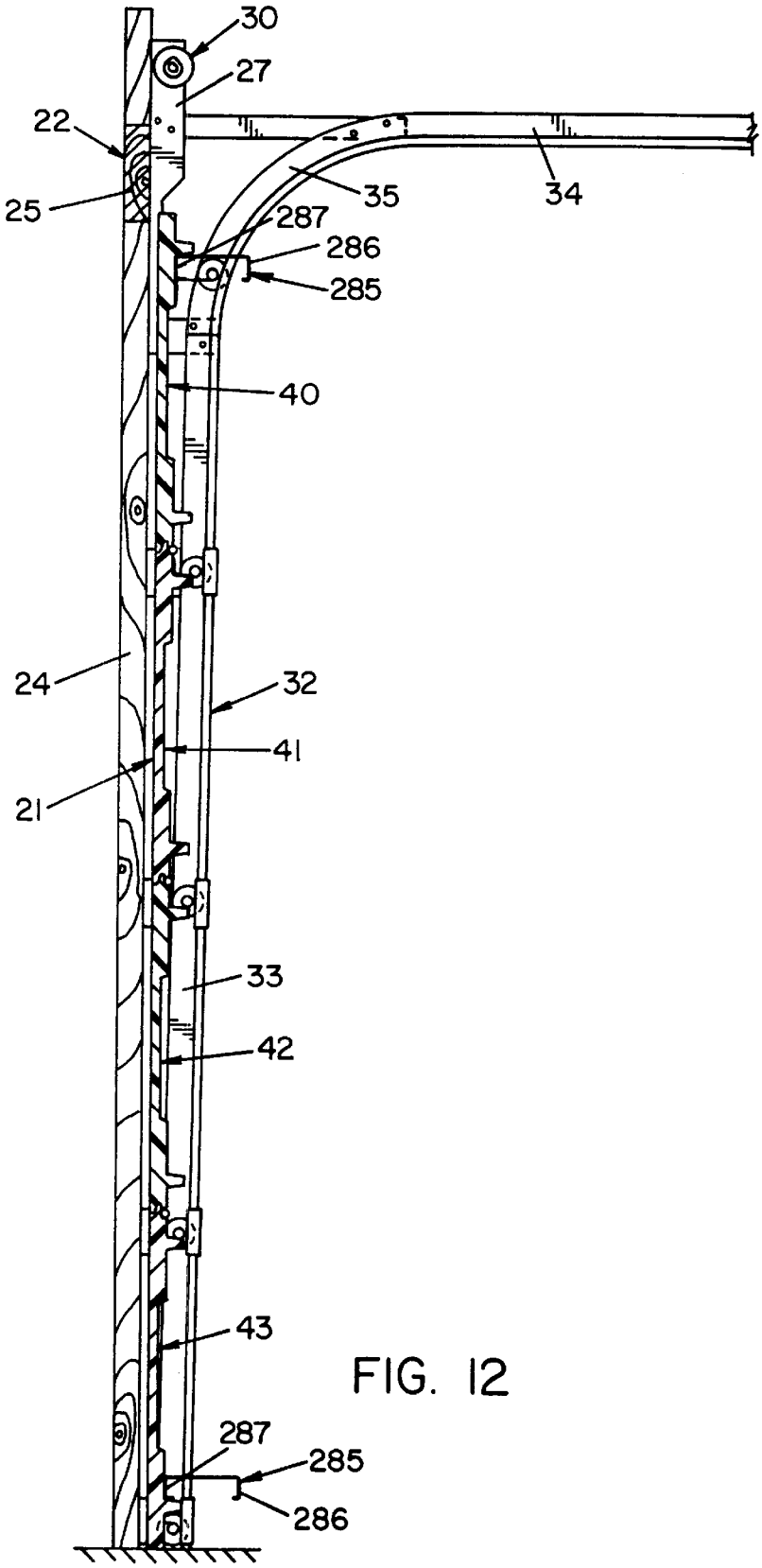
FIG. 12 is a side-elevational view of a door according to the alternate embodiment of sectional overhead door of FIG. 8 showing the use of a channel beam proximate the top of the top section and the bottom of the bottom section of the door.

In instances of requirements for resisting extreme wind velocities, the system described hereinabove may be coupled with strategically-placed beams. In particular, a pair of cross-beam assemblies, generally indicated by the numeral 285, may be positioned proximate the top and bottom of the sectional door 21, as seen in FIG. 12 of the drawings. As shown, the beam assemblies 285 consist of C-shaped channels 286 that have a flange 287 attached to the door 21 at various locations across the door width in a manner well known in the art. Thus, the beam assemblies 285 provide supplemental rigidity proximate the periphery of sectional door 21 without substantially impairing the overall ability of sectional door 21 to remain flexible and thus transfer wind-imparted forces over the skin, core, and inner substrate in the manner contemplated by the instant invention.

In instances of extreme wind-loading resistance requirements, the beam assemblies 285 could be supplemented by one or more header lock mechanisms 95, as described above in conjunction with FIGS. 1 and 7 of the drawings. Similarly, the bottom of bottom panel 43 of sectional door 21 may be provided with one or more bottom cleat assemblies, generally indicated by the numeral 290 in FIG. 13. As shown, the bottom cleat assemblies 290 may consist of a bracket 291 attached to bottom panel 43 proximate the lower extremity thereof as by suitable fasteners 292. The bracket 291 has a projecting tongue 293 matingly engages a recess 294 formed in the floor F of a building where sectional door 21 is installed. The bracket 291 thus restrains inward or outward movement of the door 21 in its closed position. As will be appreciated, a single bottom cleat assembly 290 could be positioned medially of the width of door panel 43, or a plurality of bottom cleat assemblies 290 could be positioned at different locations along the longitudinal length of panel 43.

Figure 14:
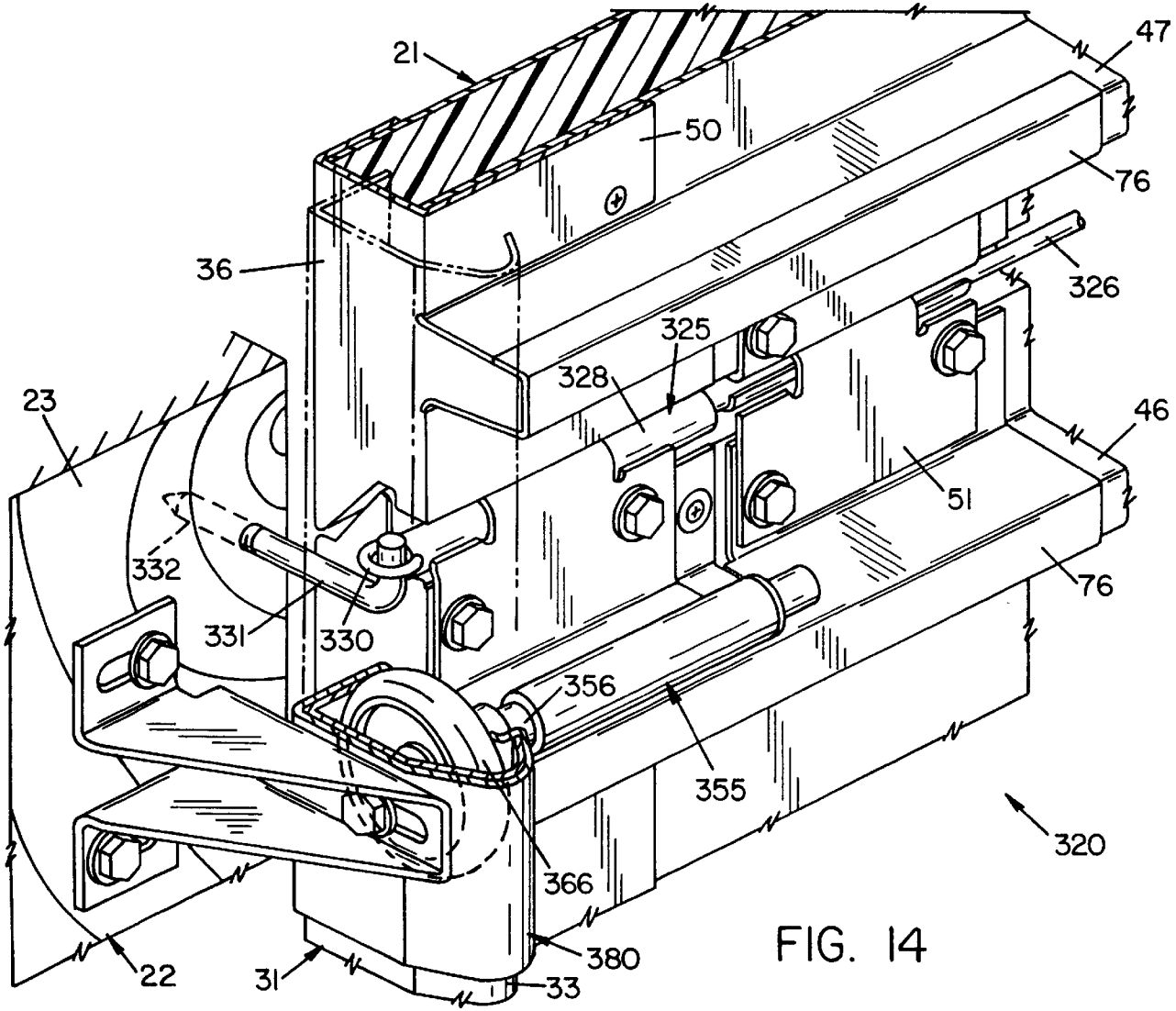
FIG. 14 is a side perspective view similar to FIG. 4 of a second alternate embodiment of a sectional overhead door according to the concepts of the present invention employing tension rod assemblies extending the length of the door sections that attach directly to the door jamb.
Figure 15:
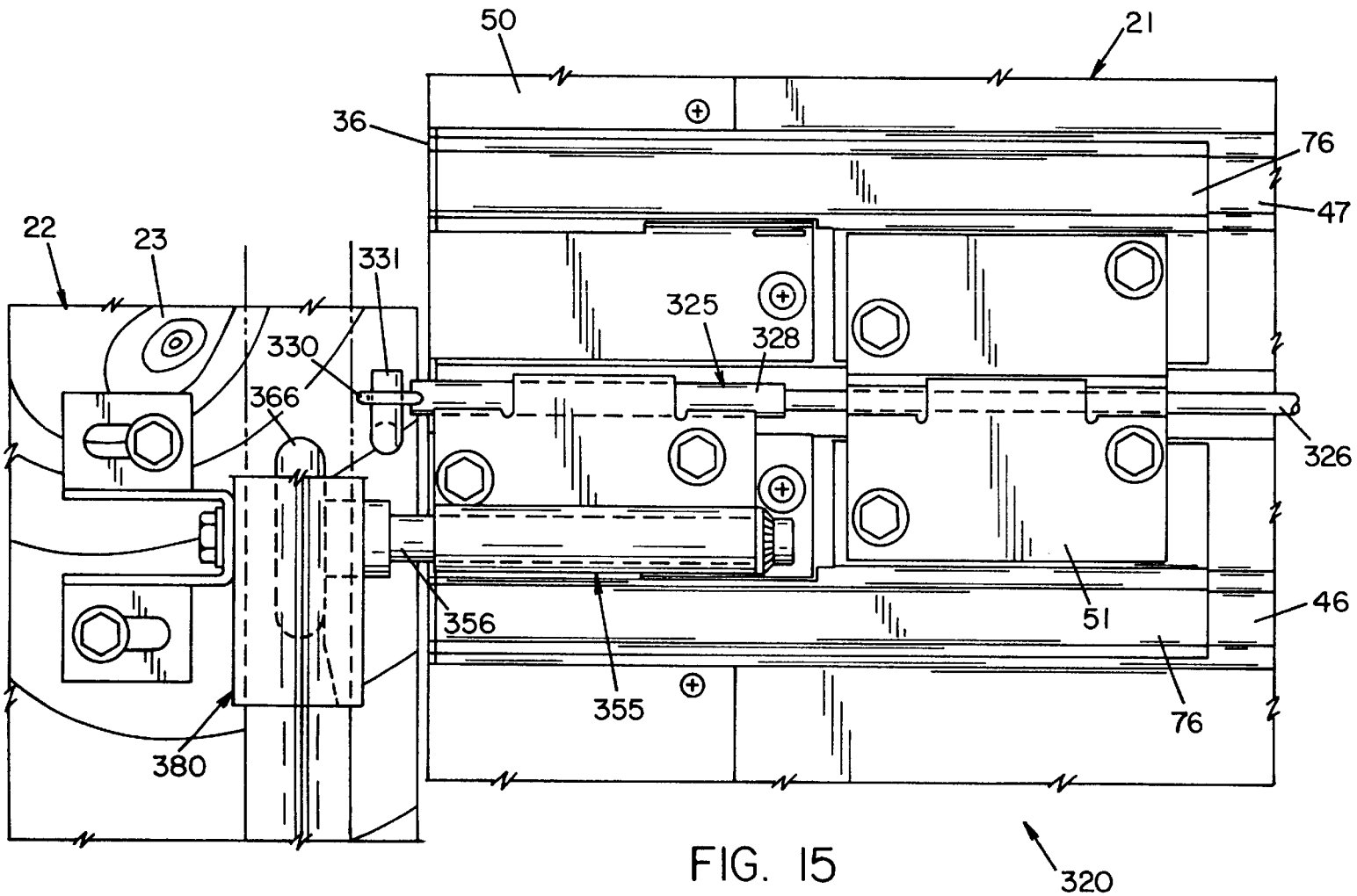
FIG. 15 is a rear-elevational view of the second alternate embodiment of sectional overhead door of FIG. 14.
Figure 16:
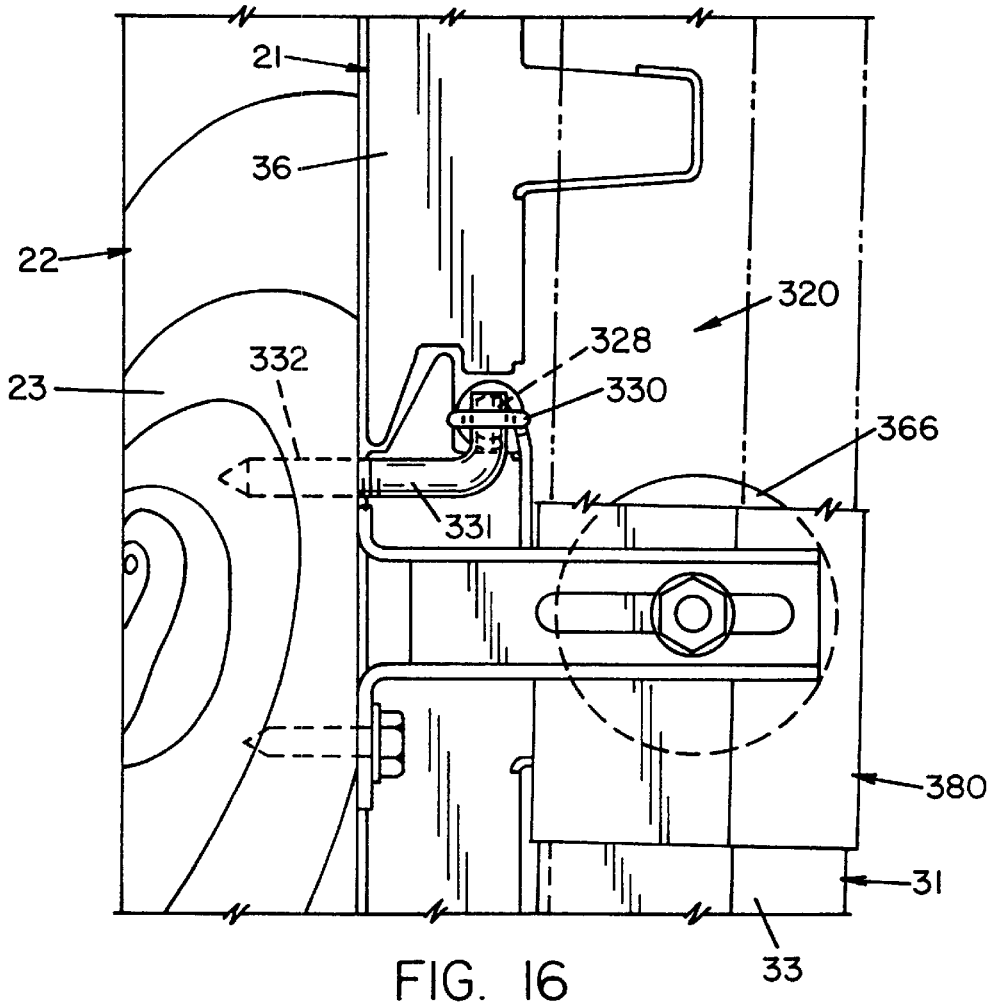
FIG. 16 is a side-elevational view of the second alternate embodiment of sectional overhead door of FIG. 14 showing details of the attachment of the tension rod assemblies to the door jamb.

Another alternate embodiment of a wind-resistant door system according to the present invention is generally indicated by the numeral 320 in FIGS. 14–16 of the drawings. The door system 320 is similar in many respects to the door system 220 shown in FIGS. 8–10 of the drawings, while at the same time differing in significant respects. The following description points up the similarities while detailing the differing features.

The door system 320 has tension rod assemblies 325, which are similar to tension rod assemblies 225 in numerous respects. Tension rod assemblies 325 have a through rod 326, which may be identical to the through rod 226. Through rods 326 terminate at either end in end connector rods 328. The end connector rods 328 may attach to through rods 326 in the manner described above in conjunction with end connector rods 228 and through rods 226. The extremity of end connector rods 328 opposite through rods 326 project a distance outwardly of the end cap 50 of sectional door 21 and terminate in a projecting eye 330. The eye 330 may be permanently formed at the end of end connector rods 328 and lie in substantially a horizontal plane. The eye 330 is oriented and positioned to engage a hook 331 when the sectional door 21 moves into the closed position. The hook 331 may be generally L-shaped, as best seen in FIG. 16, and have a threaded extension 332 that penetrates and affixes hook 331 to the jamb member 23.

It will thus be appreciated that the tension rod assemblies 325 directly interconnect the through rod 326 to the jamb member 23 when the door 21 is in the closed position. Thus, in the instance of tension rod assemblies 325, there is a direct transmittal of wind-induced forces from the door panels 40–43 to tension rod assemblies 325 and then to the jamb members 23, 24 via the hook 331. This differs from the transmittal of forces through tension rod assemblies 225, roller mounting brackets 255, roller shafts 265, rollers 266, and track reinforcing jamb bracket assemblies 280 in the case of the door system 220. The door system 320 may be provided, as shown in FIGS. 14–16, with centerhinges 51 through which through rods 326 extend and rollermounting brackets 355, which may be identical to the roller mounting brackets 255. The roller mounting brackets 355 carry shafts 365 and guide rollers 366, which interact with track jamb bracket assemblies, generally indicated by the numeral 380, all of which may be structurally identical to the corresponding components of door system 220. Thus, in the door system depicted in FIGS. 14–16, wind-induced forces are distributed from the door 21 via tension rod assemblies 325 to the jamb members 23, 24 and from the door 21 to roller mounting brackets 355 to the jamb members 23, 24. The tension rod assemblies 325 may be installed through the hinges 51 or otherwise located in the manner of tension rods 225, as discussed in conjunction with FIG. 11 above. It will further be appreciated that door system 320 may incorporate bottom cleat assemblies 290 and/or beam assembles 285, as well as header lock mechanisms 95, as discussed above in conjunction with FIGS. 13, 12, and 7.

While it is advantageous to employ the tension rod assemblies 325 to transfer forces from a wider area on door 21 to the jamb members 23 and 24, the eyes 330 or other catch members could be mounted on end caps 50 of panels 40–43 at spaced vertical locations to engage hooks 331 or other latch members affixed to the jamb members 23, 24 when the door 21 is in the closed position. It is to be appreciated that the eyes 330 or catches could be mounted on the jamb members 23, 24 while the hooks 331 or latch members could be affixed to the panels 40–43.

Figure 18:
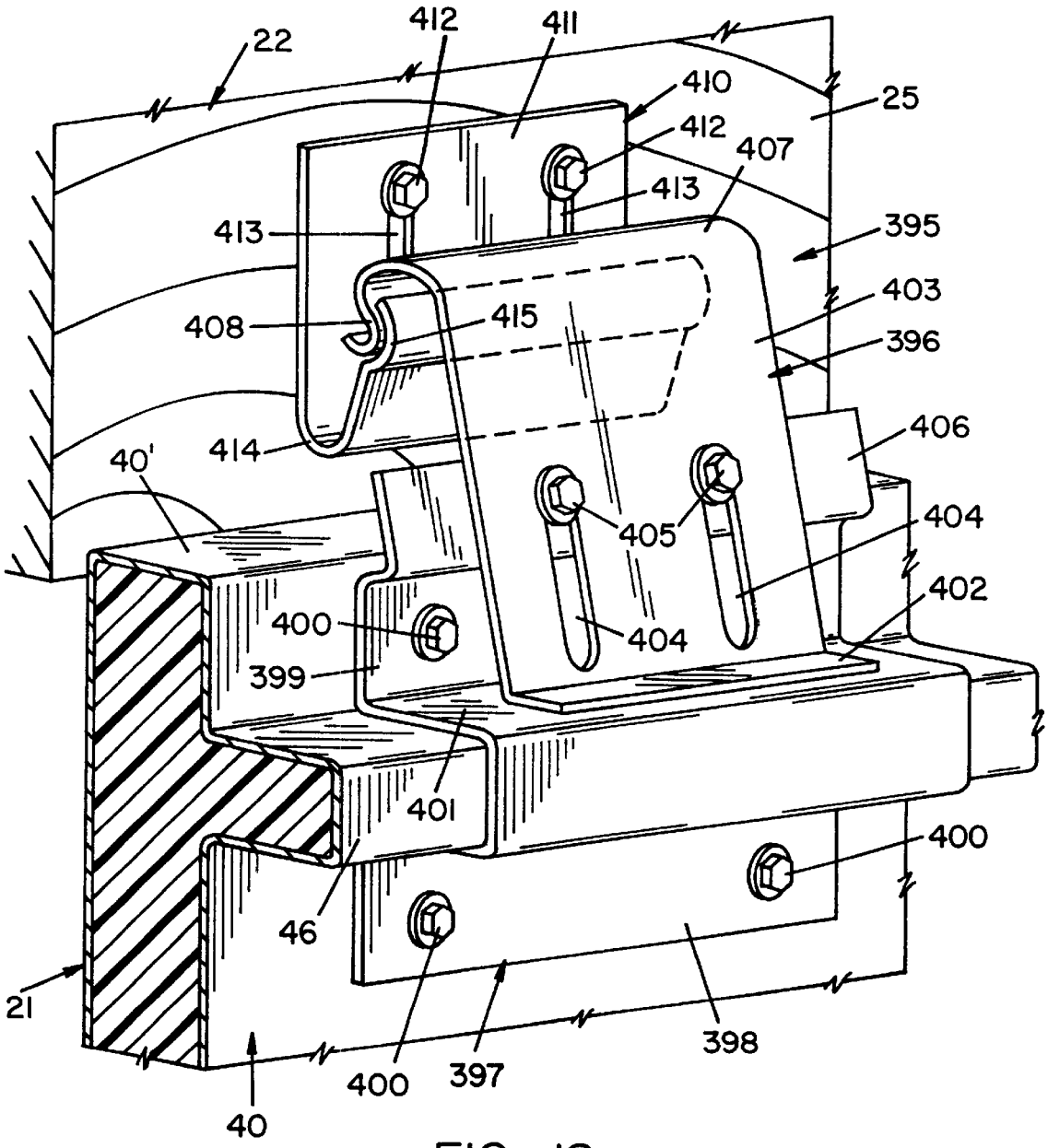
FIG. 18 is a perspective view similar to FIG. 7 of an alternate form of header lock mechanism showing the sectional overhead door in the closed position.

Particularly in instances of higher wind-resistance requirements or where a more flexible sectional door 21 may be employed, torsional forces between the top panel 40 of a door 21 and a header 25 may be accommodated by an alternate form of header lock mechanism, generally indicated by the numeral 395 in FIG. 18. As in the instance of header lock mechanism 95 depicted in FIGS. 1 and 7, a single header lock mechanism 395 may be positioned medially of top panel 40, or a plurality of header lock mechanisms 395 may be spaced along the length of top panel 40 in the event of a wider door 21 or more stringent wind-force requirements.

As shown, the header lock mechanism 395 consists of a panel bracket 396 is connected to a panel bracket attachment plate 397. The panel bracket attachment plate 397 has a pair of attachment surfaces 398 and 399 that may be substantially coplanar for securing proximate the top edge 40' of top panel 40 of door 21 as by a plurality of fasteners 400. The panel bracket attachment plate 397 is provided with an offset mounting surface 401 that receives a support leg 402 of the panel bracket 396. Panel bracket 396 has an extension arm 403 extending upwardly from support leg 402 a sufficient distance to overlie the header 25. Extension arm 403 has vertical slots 404 that receive fasteners 405, which engage an upper leg 406 of the panel bracket attachment plate 397. The extension arm 403 of panel bracket 396 has a reverse curve section 407, which merges into an engaging surface in the form of cylindrical knuckle 408.

The header lock mechanism 395 has a header bracket 410 having an attachment plate 411 that is adjustably vertically positioned on header 25 by a plurality of fasteners 412 that extend through slots 413 in attachment plate 411 and are anchored in the header 25. Header bracket 410 extends downwardly from attachment plate 411 into a U-shaped return 414 that terminates in an engaging surface in the form of a cylindrical knuckle 415 that lies rearwardly of but proximate to the cylindrical knuckle 408 of panel bracket 396. The brackets 396, 410 are preferably adjustably positioned so that cylindrical knuckles 408 and 415 are proximate to but spaced from each other a small distance so that cylindrical knuckle 408 of panel bracket 396 may move into overlapping relation with cylindrical knuckle 415 as the door 21 closes without interfering engagement. It will be appreciated that the separation of the top panel 40 from header 25 under extreme wind loading would bring the cylindrical knuckle 408 into engagement with cylindrical knuckle 415 to thus restrain further separation of top panel 40 from header 25 and to dissipate stresses to the header 25. The knuckles 408 and 415 are so configured such as to create an extent of hinging or pivotal motion between knuckles 408, 415 to permit an extent of rotation by deformation of door 21 without introducing torsional stress concentrations in header lock mechanism 395 or its attachment to door 21 or header 25.

It is to be appreciated that header lock mechanism 95 could be variously configured to carry out the requirements of precluding separation between door 21 and header 25 while permitting an extent of relative rotation therebetween. For example, the engaging surfaces 408, 415 could take the form of a raised ball and ball socket or the like in lieu of the cylindrical knuckles 408, 415.

Thus, it should be evident that the wind-resistant sectional overhead door disclosed herein carries out one or more of the objects of the present invention set forth above and otherwise constitutes an advantageous contribution to the art. As will be apparent to persons skilled in the art, modifications can be made to the preferred embodiments disclosed herein without departing from the spirit of the invention, the scope of the invention herein being limited solely by the scope of the attached claims.

What is claimed is:

1. A sectional overhead door assembly comprising, a door having a top panel, a frame surrounding said door and having a header positioned proximate said top panel when said door is in the closed position, a header bracket attached to said header, a panel bracket attached to said top panel, a first engaging surface on said header bracket, a second engaging surface on said panel bracket in overlapping position relative to said first engaging surface and separated a small distance therefrom when said door is in the closed position, whereby said door moves relative to said frame without interfering engagement of said engaging surfaces during normal operation of the door while providing engagement of said engaging surfaces to preclude substantial separation of said door from said header upon deformation of said door during wind loading, said panel bracket having an extending arm and a reverse curve section merging into said first engaging surface and wherein said header bracket has a U-shaped return merging into said second engaging surface.

2. A sectional door assembly according to claim 1, wherein said first and second engaging surfaces are substantially parallel when said door is in the closed position.

3. A sectional door assembly according to claim 1, wherein said first and second engaging surfaces have knuckles, whereby an extent of rotation of said engaging surfaces caused by deformation of said door is permitted without introducing torsional stress concentrations in any of said header bracket, said panel bracket, said header, and said door.

4. A sectional door assembly according to claim 1, wherein at least one of said header bracket and said panel bracket is adjustably positioned.

5. A sectional door assembly comprising, a door having a top panel, a frame surrounding said door and having a header positioned proximate said top panel when said door is in the closed position, a header bracket attached to said header, a panel bracket attached to said top panel, a first engaging surface on said header bracket, a second engaging surface on said panel bracket in overlapping position relative to said first engaging surface and separated a small distance therefrom when said door is in the closed position, whereby said door moves relative to said frame without interfering engagement of said engaging surfaces during normal operation of the door while providing engagement of said engaging surfaces to preclude substantial separation of said door from said header upon deformation of said door during wind loading, said first and second engaging surfaces having knuckles, whereby an extent of rotation of said engaging surfaces caused by deformation of said door is permitted without introducing torsional stress concentrations in any of said header bracket, said panel bracket, said header, and said door.

6. A sectional door assembly according to claim 5, wherein said knuckles are cylindrical.

7. A sectional door assembly comprising, a door having a top panel, a door frame having a header positioned proximate said top panel when said door is in the closed position, a header bracket attached to said header, a panel bracket attached to said top panel, a first engaging surface on said header bracket having a first knuckle, a second engaging surface on said panel bracket having a second knuckle configured to freely pivotally engage said first knuckle, whereby said engaging surfaces preclude substantial separation of said door from said header while permitting rotation of the door relative to said header upon deformation of said door during wind loading.

8. A sectional door assembly according to claim 7, wherein said knuckles have mating curved surfaces.

9. A sectional door assembly according to claim 7, wherein said knuckles are cylindrical.

10. A sectional door assembly according to claim 7, wherein at least one of said header bracket and said panel bracket is selectively adjustably positioned.

* * * * *